United States Patent [19]

Urdaneta

[11] Patent Number: 4,722,158

[45] Date of Patent: Feb. 2, 1988

[54] SYSTEM OF INDIVIDUAL MODULES WHICH CAN BE FITTED TOGETHER TO FORM DECORATIVE OR ARTISTIC PANELS

[76] Inventor: Enrique A. Urdaneta, Av. Luis Roche con 3a Transversal Edif. Bronce, Altamira - Caracas, Venezuela

[21] Appl. No.: 683,222

[22] Filed: Dec. 18, 1984

[51] Int. Cl.[4] ..... E04C 2/20; E04C 2/32

[52] U.S. Cl. ..... 52/316; 428/167; 428/166; 428/38; 40/596; 40/616; D25/138

[58] Field of Search ..... 52/312, 311, 316, 602, 52/630; 428/46, 167, 47, 79, 78, 38, 49, 166; D25/80; 40/596, 616, 160, 615; 446/108, 118, 115, 129, 128; 273/157 R, 160, 156

[56] References Cited

U.S. PATENT DOCUMENTS

| | | | |
|---|---|---|---|
| D. 210,903 | 4/1968 | Dalton | D25/80 |
| D. 236,989 | 9/1975 | Holman | D25/80 |
| D. 243,095 | 1/1977 | Stichtenoth | D25/80 |
| 1,040,932 | 10/1912 | Gray | 40/616 |
| 1,840,226 | 1/1932 | Chase | 52/316 |
| 1,973,564 | 9/1934 | Graham | 273/157 R |
| 2,038,615 | 4/1936 | Underdown | 52/602 |
| 2,163,454 | 6/1939 | Slick | 52/308 |
| 2,587,325 | 2/1952 | Husted | 40/616 |
| 2,812,691 | 11/1957 | Boyd | 52/308 |
| 2,876,574 | 3/1959 | Powell | 40/616 |
| 3,252,260 | 5/1966 | Mills | 52/308 |
| 3,284,889 | 11/1966 | Flitman | 40/616 |
| 3,555,757 | 1/1971 | Volent | 52/390 |

FOREIGN PATENT DOCUMENTS

| | | | |
|---|---|---|---|
| 765168 | 8/1967 | Canada | 40/616 |
| 2016639 | 11/1971 | Fed. Rep. of Germany | 52/602 |
| 980812 | 5/1951 | France | 52/316 |
| 2330827 | 7/1975 | France | 52/316 |
| 640215 | 5/1962 | Italy | 40/615 |

OTHER PUBLICATIONS

Journal of the American Concrete Institute, May 1960, p. 1138.

*Primary Examiner*—John E. Murtagh

*Attorney, Agent, or Firm*—Webb, Burden, Robinson & Webb

[57] ABSTRACT

A system of individual modules, which can be fitted together for the formation of decorative or artistic panels is disclosed. The individual modules have geometrical figures in high relief, therefore defining two different planes, the first determined by the high relief geometrical figures and the second by the lower plane which constitutes the pictorial background of the total composition. The resulting combination formed by joining together the geometrical figures of the modules, as well as the combination of colors and textures, having similar or different hues, of product and substances of different origin, applied by means of casting or adherence, upon a plane or in both, results in the formation of artistic or decorative figures displayed upon the panel integrated by the modules fitted together. The panels thus formed, are used to create works of art or decorative works applied or integrated to architecture, such as stained glass windows, murals, ceilings, socles, internal and external partitions, doors, decorated floors or decorative or utilitarian elements or objects, such as lamps, internal and external sculptures, electric signboards, painting and mirror frames, secondary furniture, etc., with each panel having a novel and artistic design, aesthetically elaborate, to break or neutralize the monotonousness plain surface, with the particular fact that the planes in different levels, having different or equal colors or textures, make stand out given areas or the total design.

8 Claims, 194 Drawing Figures

FIG. 5
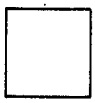
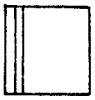
VH-1
FIG.6a
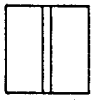
VH-2
FIG.6b
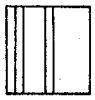
VH-12
FIG.6c
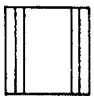
VH-13
FIG.6d
FIG.6e
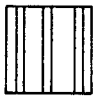
VH-123
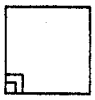
L-1
FIG.7a
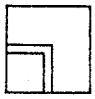
L-2
FIG.7b
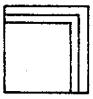
L-3
FIG.7c
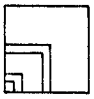
L-12
FIG.7d
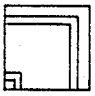
L-13
FIG. 7e
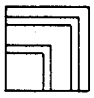
L-23
FIG.7f
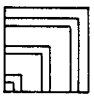
L-123
FIG.7g

D-123456

D-1

D-2

D-3

D-12

D-23

D-34

D-13

D-24

D-14

D-25

D-15

D-16

D-123

D-234

D-134

D-135

D-124

D-136

D-235

D-125

D-126

D-145

D-1234

D-1235

D-1236

D-1245

D-1246

D-1345

D-1346

D-2345

CA-1

CA-2

CA-3

CA-4

CA-12

CA-13

CA-14

CA-23

CA-24

CA-34

CA-123

CA-124

CA-134

CA-234

CA-1234

CB-4

CB-5

CB-6

CB-45

CB-46

CB-56

CB-456

CC-5

CC-6

CC-56

CD-4

CD-5

CD-6

CD-45

CD-46

CD-56

CD-456

DD-1

DD-2

DD-3

DD-4

DD-12

DD-13

DD-14

DD-23

DD-24

DD-34

DD-123

DD-124

DD-134

DD-234

DD-1234

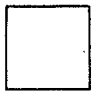
FIG.17a
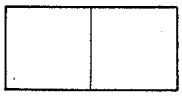
FIG.17b
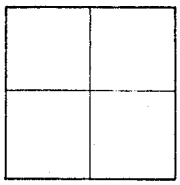
FIG.17c
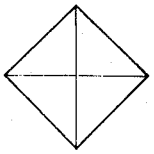
FIG.17d
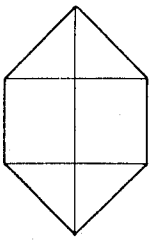
FIG.17e
FIG.17f
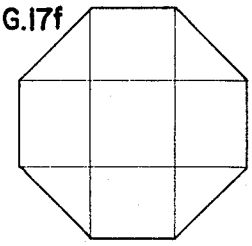
FIG.17g
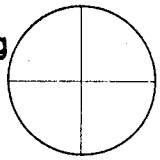
FIG.17i
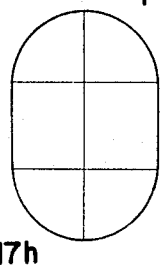
FIG.17h
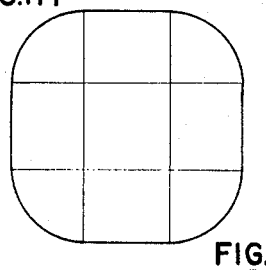
FIG.17l
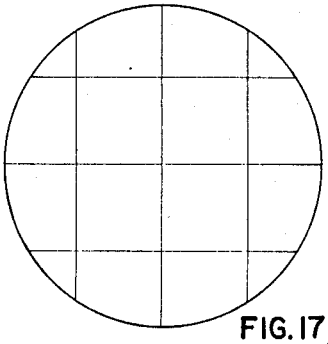
FIG.17j
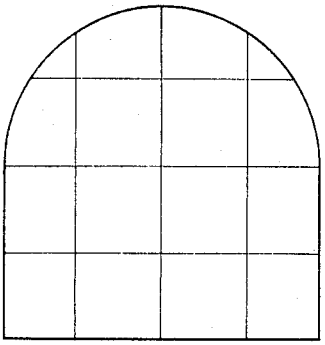
FIG.17k
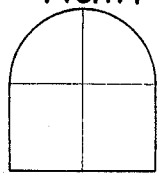
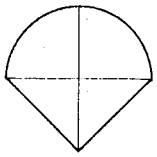
FIG.17m
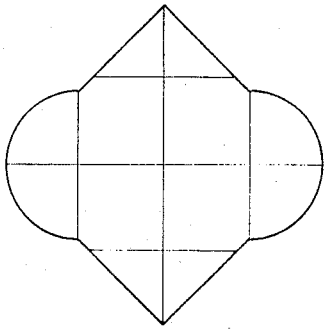
FIG.17n FIG. 31
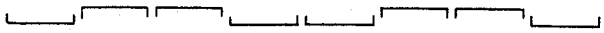
FIG. 32
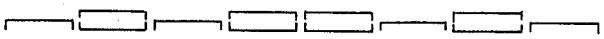
FIG. 33
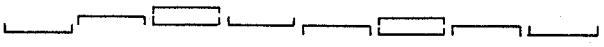
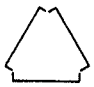
FIG. 34a
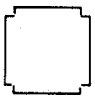
FIG. 34b
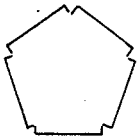
FIG. 34c
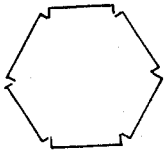
FIG. 34d
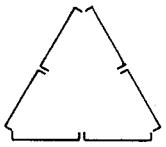
FIG. 34e
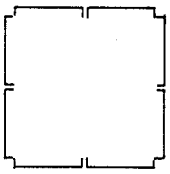
FIG. 34f
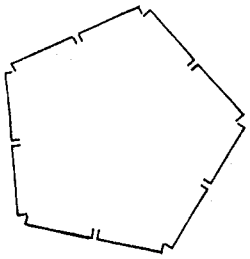
FIG. 34g
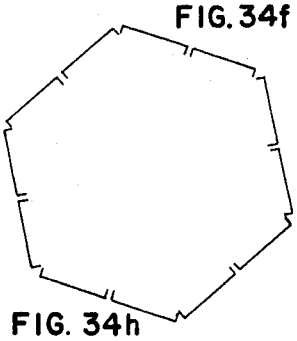
FIG. 34h

SYSTEM OF INDIVIDUAL MODULES WHICH CAN BE FITTED TOGETHER TO FORM DECORATIVE OR ARTISTIC PANELS

BACKGROUND OF THE INVENTION

1. Field of the Invention

The present invention relates to a system of individual modules having sections in high relief that, when combined, provide an architect, artist or decorator obtaining works of art, with decorative figures or utilitarian elements that are appliable or can be integrated with or integrated to architectural works, in a faster and easier way, and at lower costs, than when using standard material and techniques.

2. Description of Background Art

Man has always tried to beautify the different elements that conform the structure and architecture of the buildings that he has built, as well as for housing as for other purposes, in accordance to materials, instruments and techniques available.

Thus, it is common to find in most known ancient buildings, that walls, both internal and external, as well as ceiling and floors, are covered with painting, sculptures, carvings and engraving, made from different materials such as wood, stone, marble, clay and others, giving expression to creative, artistic or ability impulses and making at the same time propitious ambients for his recreation and relaxation, in some cases fulfilling didactical functions.

Styles and tendencies have varied, not only by evolution but also according to the materials available in each epoch. Therefore, there existed the use of well known material in combination with newly discovered ones. Wood, stone and marble, among others, constitute by themselves or in combination endless examples of works of art applied to architecture, giving an idea about the artistic quality of the artisan and professional of each epoch, and about their custom and habits.

Still subsists the custom to cover walls, ceilings, etc., with murals having figures and motives, painting, geometrical designs, etc., manifesting the artistical spirit of the architect who, when designing houses, commercial or industrial buildings, tries at the same time to obtain an aesthetical and pleasant ambient to facilitate the the activities of human beings. However, these manifestations are limited in spite of the actual availability of endless natural or synthetic materials, advanced tools and techniques that ease their handling because they involve high costs. For example, such works of art as murals, stained glass windows, high and low reliefs, decorated lamp screens, etc., which have very high costs, are confined to be used only in some luxurious buildings.

Another disadvantage and inconvenience which avoids inclusion of works of art or artistic decorations in building lies in the lack of materials easy to handle having low costs.

Therefore, there still exists a need for a system which allows design and construction of works of art as well as utilitarian and individual decorative elements, integrated to architecture, having relative low costs, readily available and handled.

SUMMARY OF THE INVENTION

Applicant has discovered a solution to the problem above posed; specifically, applicant has invented a system of individual modules, which can be fitted together, to form by means of the union of several of them a panel destined to simplify, ease and cheapen the obtention of works or art and utilitarian elements, as well as decorative objects integrated to architecture, as well as other elements, without diminishing the artistic quality of these manifestations.

The individual modules of the invention can be easily produced, starting from commonly available materials, allowing architects, artists and decorators to carry out their creations, without the difficulties and inconveniences often found with standard techniques.

A specific object of the present invention permits creation, design and carrying out of artistic stained glass windows, for which purpose the invention provides individual modules which can be fitted together, being transluscent or transparent.

Another object of the invention comprises the formation of wall coverings, or murals and socles, by means of panels formed by the individual modules of the invention fitted together, having their external surfaces equipped with decorative or artistic figures in high relief.

It is a further object of the invention to obtain panels possessing the mentioned characteristics to be used as ceilings, hiding panels combined with the lighting system.

On additional object of the invention constitutes the formation of decorated floors by means of the panels obtained with the fitting together of individual modules.

Another object of the present invention includes utilitarian objects, such as lamps, internal and external sculptures, additional furniture, individual decorative elements, etc.

A further object of the invention includes providing individual modules which can be fitted together and having means in order that the artistic or decorative figures obtained by the joining of several individual modules of the invention may have their surfaces equipped with uniform colors or combination of colors and hues, likewise having the possiblity to combine pigmented or colored surfaces with others filled with materials having different textures and surfaces being rugged, pigmented, colored or rough.

An additional object of the present invention permits the manufacturing of several objects, such as electric signboards, logotypes, to compose illuminated paintings or superpose several panels to obtain kinetic effects, as well as frames for paintings, mirrors, mobiles, sculptures, tapestries, collages and several other decorative or utilitarian elements.

It is an advantage of this invention that, through the combination or grouping of several individual modules, made in accordance with the invention, new ways are created to produce fine arts. Skillful use and combination of such combinations and groupings by the creative power of the human being allows the obtention of endless combinations with geometrical figures represented in high relief in the upper faces of the individual modules.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 is a top view similar to FIG. 3, but having its upper face without portions in high relief, forming a plain surface.

FIGS. 6*a–e* are top views showing several individual modules of the invention having their portions in high relief disposed with different separation ratios, with some of the modules having only a portion in high relief, indifferent locations on the upper face of the module. It is to be noticed that, although the portions in high relief are sown vertically oriented, they can, however, be oriented indistinctly both in a vertical or horizontal sense.

FIGS. 7*a–g* are top views showing several individual modules having their portions in high relief in form of angled lines, similar to corner pieces, at approximately 90 degrees. Also, in this figure there are shown several separation ratios between the high reliefs, when there are two or more, and the location in different places on the upper surface of them.

Figure 1:
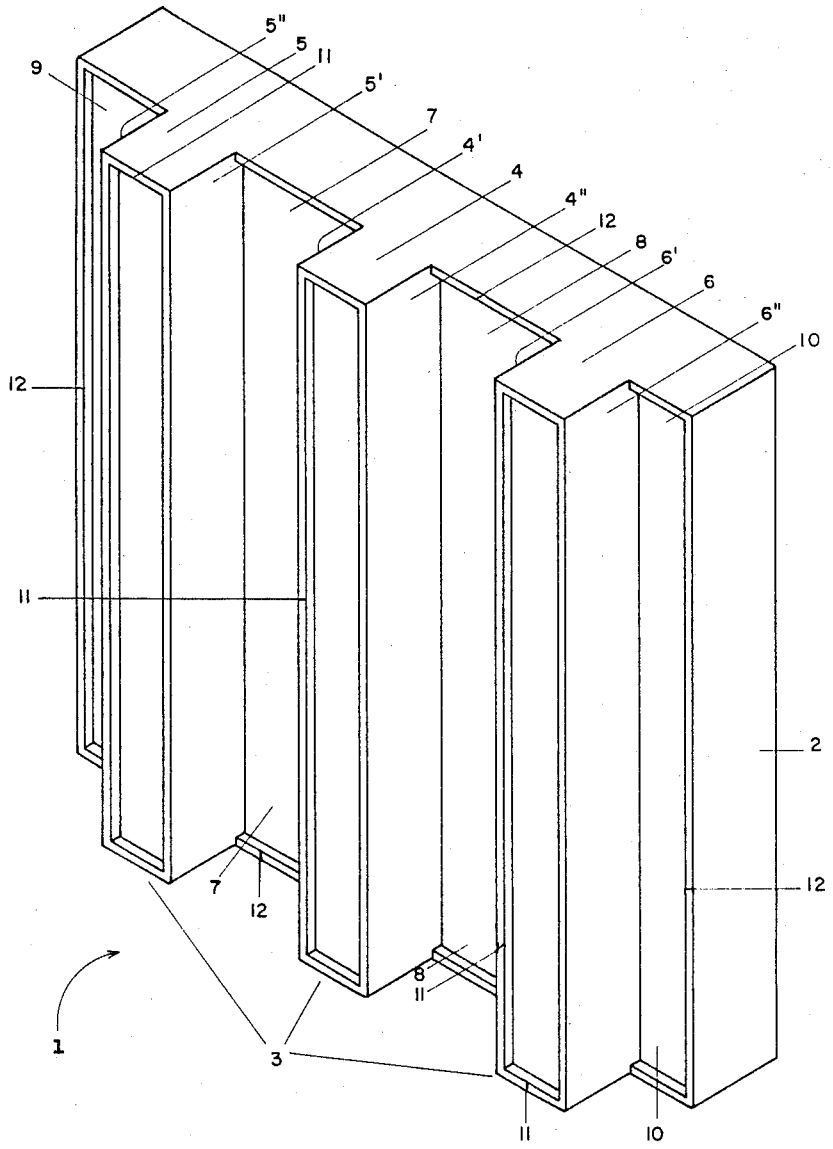
FIG. 1 is an isometrical view of an individual modules which can be fitted together with similar ones for the formation of decorative or artistic panels, having portions of its upper face in high relief, being longitudinal, parallel and equidistantly spaced apart, which geometrical figures, orientation with respect to the vertical axis and ratio of separation between themselves, constitute only examples of the endless variety of geometrical configurations, orientations and separations that can be given to such portions in high relief.
Figure 2:
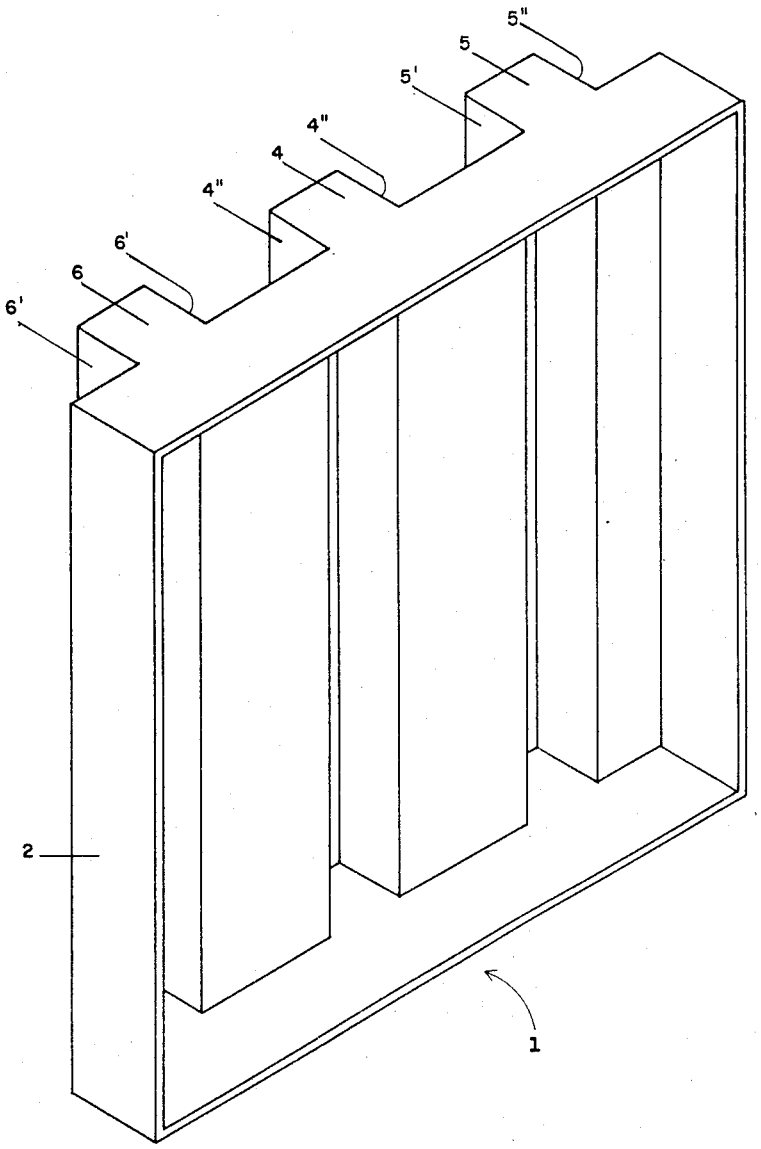
FIG. 2 is an isometrical view of the individual module shown in FIG. 1 but in a rear view.
Figure 3:
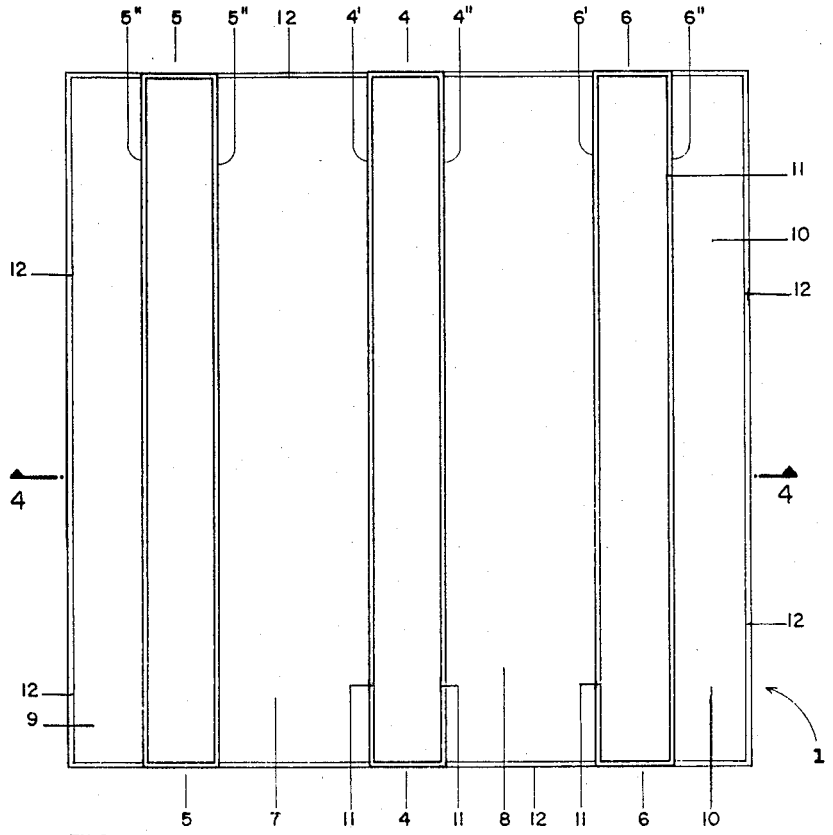
FIG. 3 is a top view of the individual modules shown in FIGS. 1 and 2, illustrating the separation ratios of the portions in high relief, between them and relative to the upper face of the module.
Figure 4:
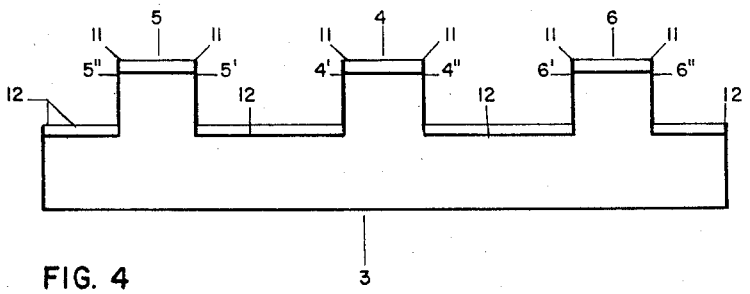
FIG. 4 is a cross sectional view taken along the line X—X of FIG. 3.

In respect to FIGS. *7a–g*, 8*a–ae*, 9*a–af*, 10 and 11*a–o*, the same comments made regarding the portions in high relief of FIGS. 6*a–e* are applicable. In the drawings said portions in high relief are shown having determined orientations, but it is evident that the turning of the module around its geometrical center will vary the orientation of the portions in high relief relative to that illustrated, which allows each module to be adapted into the final work in which the orientation designed by the artist, architect or decorator.

Figure 12:
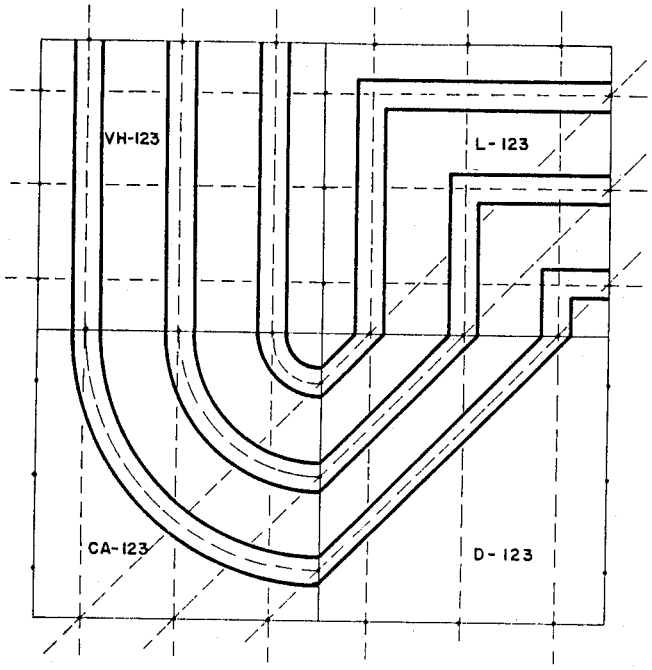

FIG. 12 is a top view showing four individual modules fitted together integrating a simple panel, or a section of a bigger panel, in which the portions in high relief combined illustrate a decorative geometrical figure, which have continuity due to the fact that their geometrical axis are coincident.

Figure 13:
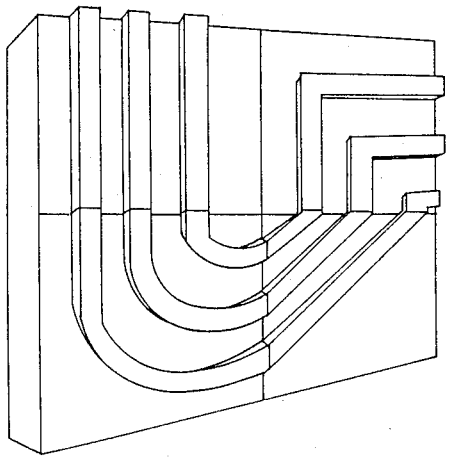

FIG. 13 is an oblique perspective of the simple panel, or section of a bigger panel, shown in FIG. 12.

Figure 14:
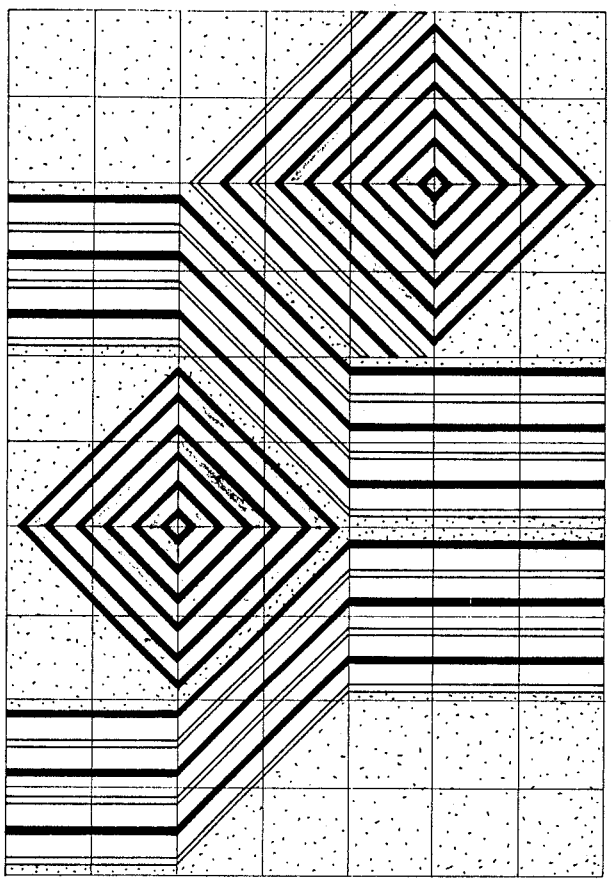

FIG. 14 is a top view of a panel formed by fitting together a plurality of individual modules, with their portions in high relief representing geometrical figures and some enclosing lines, with some of the modules having their upper faces plains, in other words, not having portions in high relief, defining or completing the pictorial background of the panel. This panel is a simple example regarding the formation of decorative or artistic murals.

Figure 15:
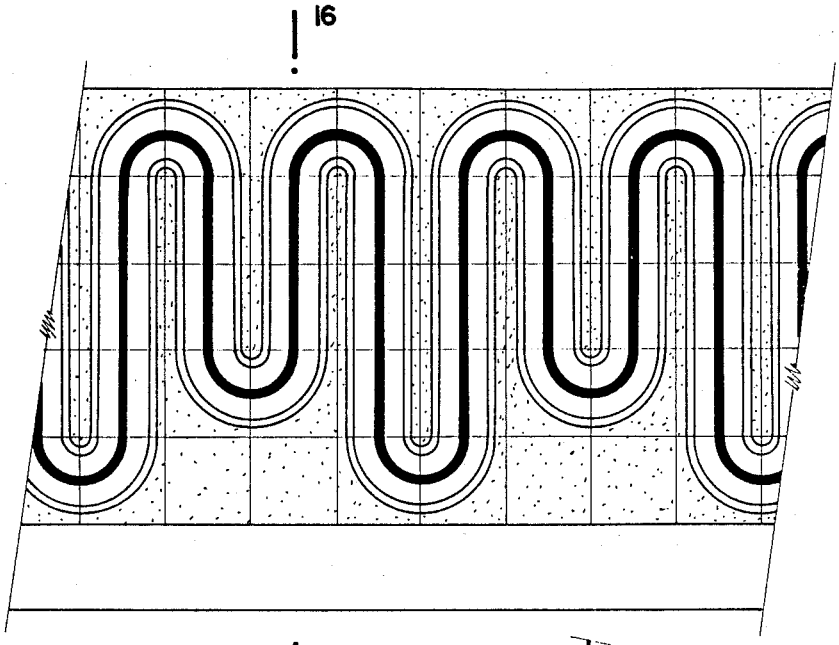

FIG. 15 is a top view of a panel or section of a bigger panel, composed by fitting together a plurality of individual modules of the invention, with their portions in high relief determining in this case a geometrical figure having the shape of a sinusoidal object. This panel represents a simple example of the obtention of a socle by means of the individual modules of the present invention.

Figure 16:
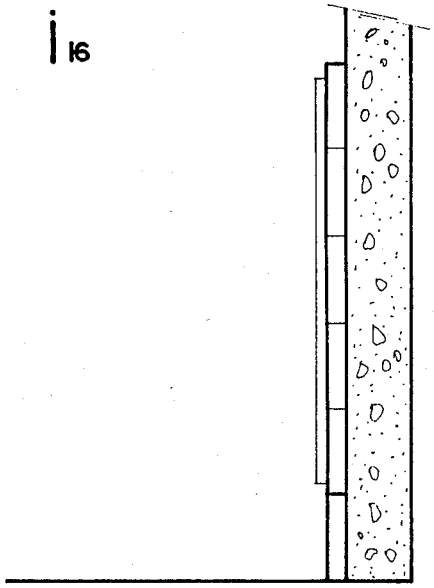

FIG. 16 is a cross sectional view illustrating a wall and a panel formed in accordance with this invention and used as a socle.

FIGS. 17*a–n* illustrate several examples of the endless variety of panels obtainable with the combination of the modules of the invention, having in these cases their perimeters defining different geometrical forms, and combinations thereof.

Figure 18:
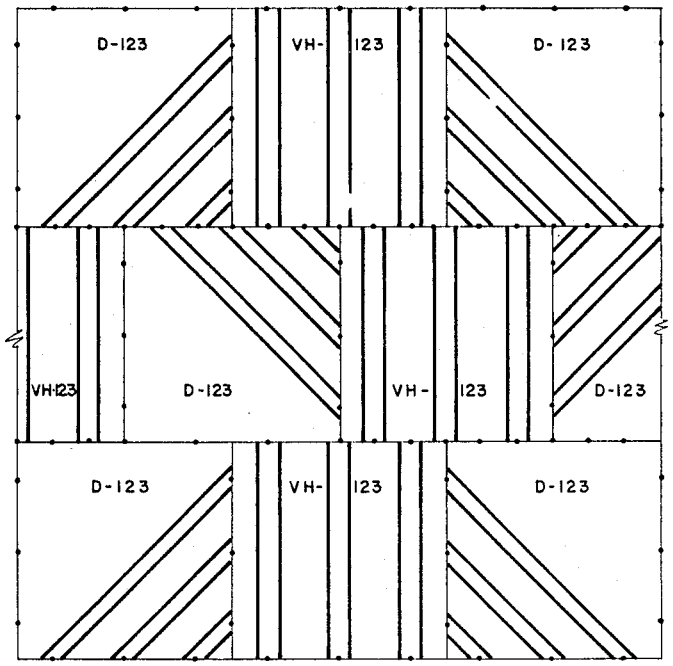

FIG. 18 shows a panel formed by fitting together several individual modules of the invention, in a top view, in which panel the portions in high relief of each individual modules have not their geometrical axis in coincidence, as opposed to the panels shown in FIGS. 12, 13 and 14. This panel illustrates that the invention permits to the artist, architect or decorator to design and carry out its designs without any limitation to their creativity.

Figure 19:
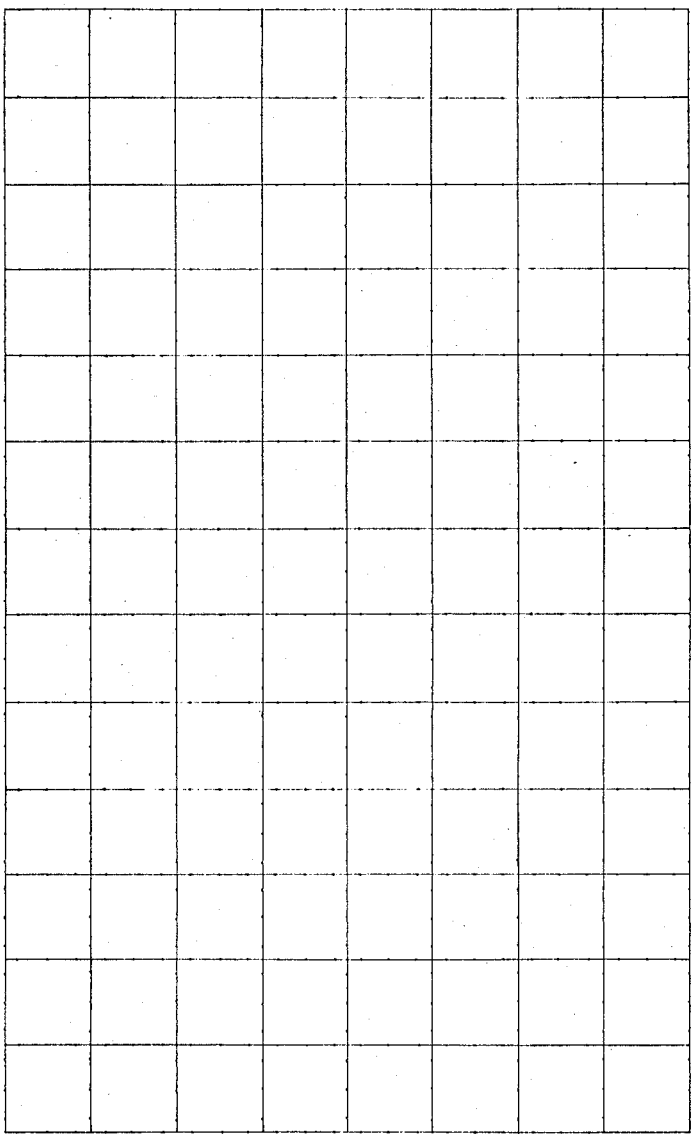
Figure 20:
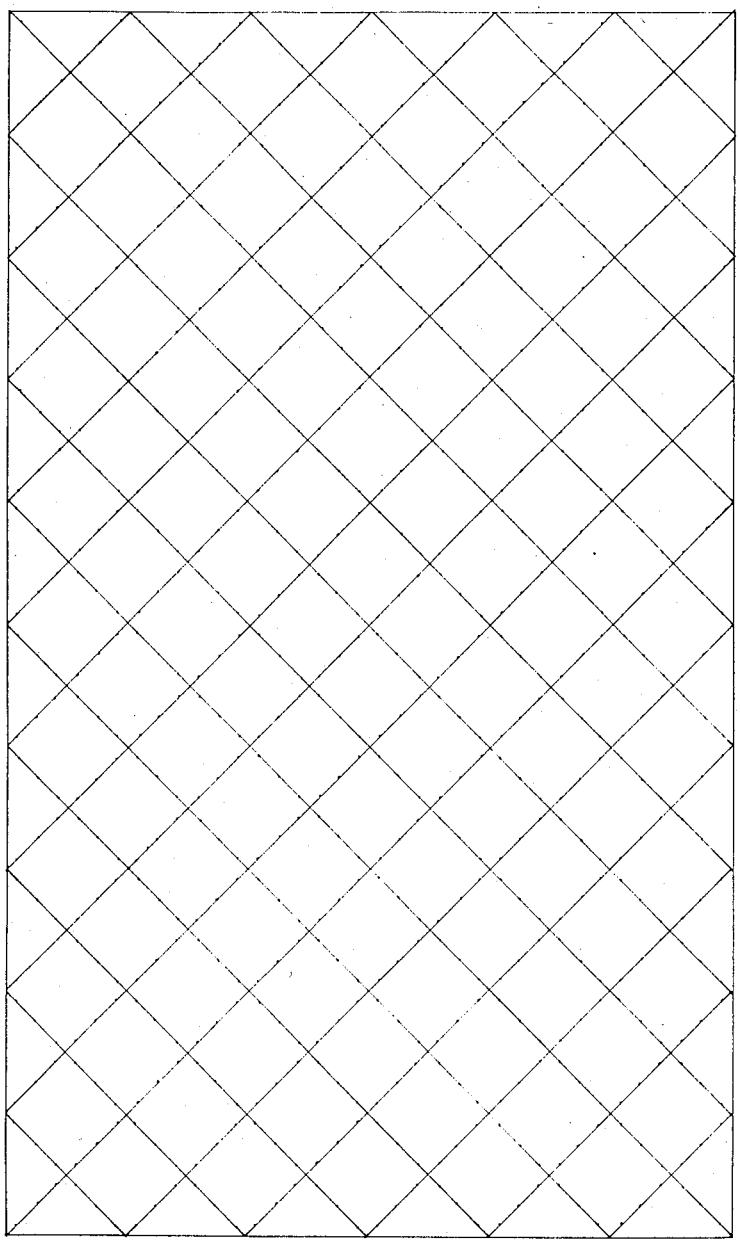

FIGS. 19 and 20 are recticula composed, respectively, by squares and rhombuses, which sides are equipped with guide dots which are aligned. These reticula in printed form assist the architect, artist or decorator to make their design of decorative or artistic panels. To that purpose, each equare or rhombus represents an individual module and the guide dots represent the geometrical axis of the potions in high relief. Therefore, to design a decorative or artistic panel, it would suffice to draw straight, vertical, horizontal, broken or mixed, diagonal or curved lines between the guide dots until the desire figure is obtained.

Figure 21:
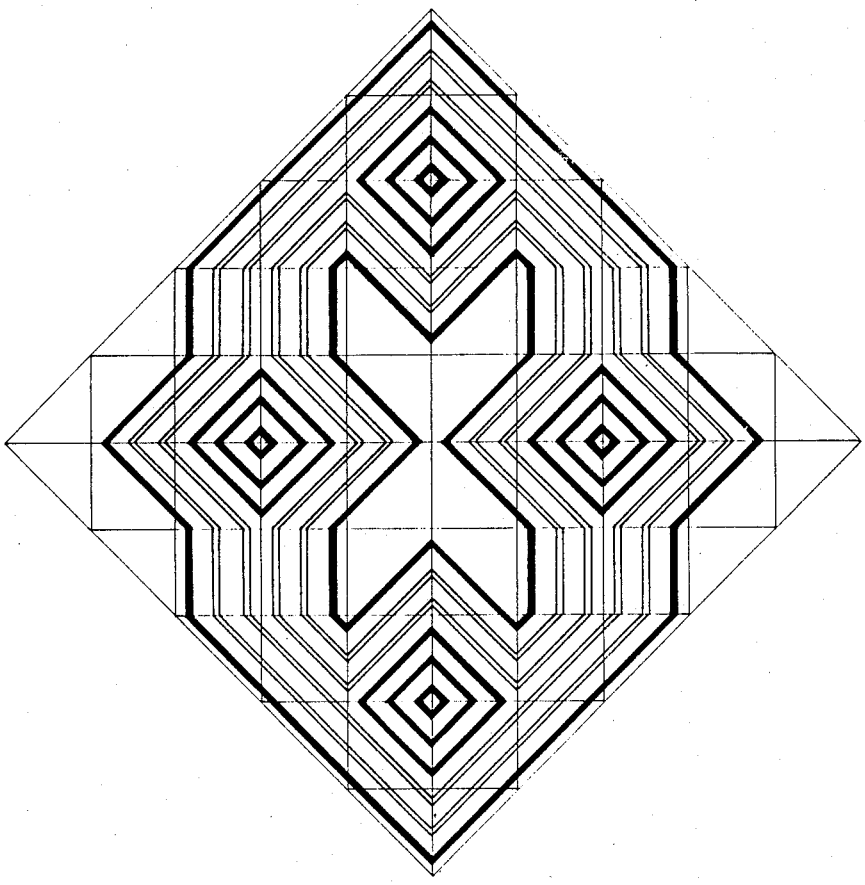

FIG. 21 is a top view of a panel formed by fitting together individual modules of the present invention, which, in this particular case, is intended to serve as a stained glass window, with its perimeter forming a rhombus.

It should be observed, in respect to FIGS. 17*a–n* and 21, that the perimeter of the panels there shown, are obtained by sectioning those modules abutting with it.

Figure 22:
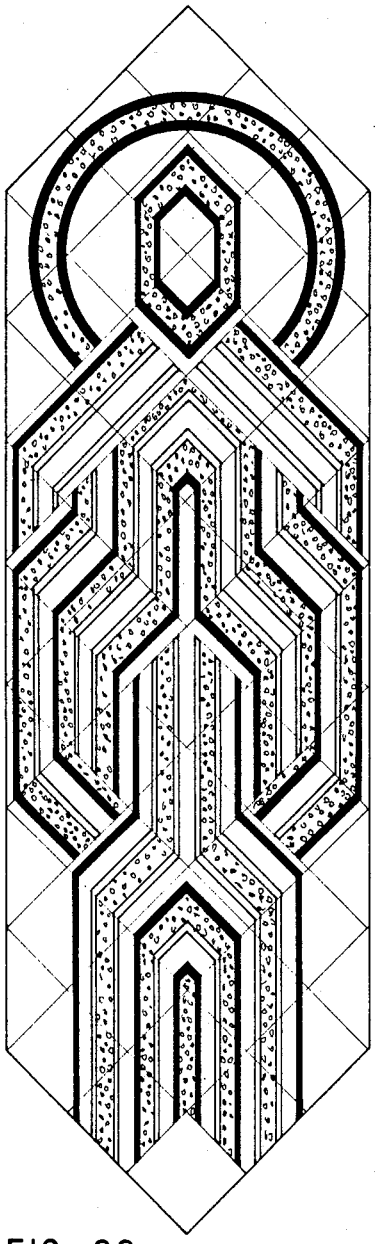

FIG. 22 is a top view of a panel formed by fitting together several individual modules of the invention, intended in this case to serve as a composite stained glass window, which, opposite to the stained glass window shown in FIG. 21, has the surfaces of its portions in high relief filled with a material providing a rugged texture, such as granite pebbles, while the surface defined by the lower level as a pictorial background is covered by a plastic material, such as a polyester.

Figure 23:
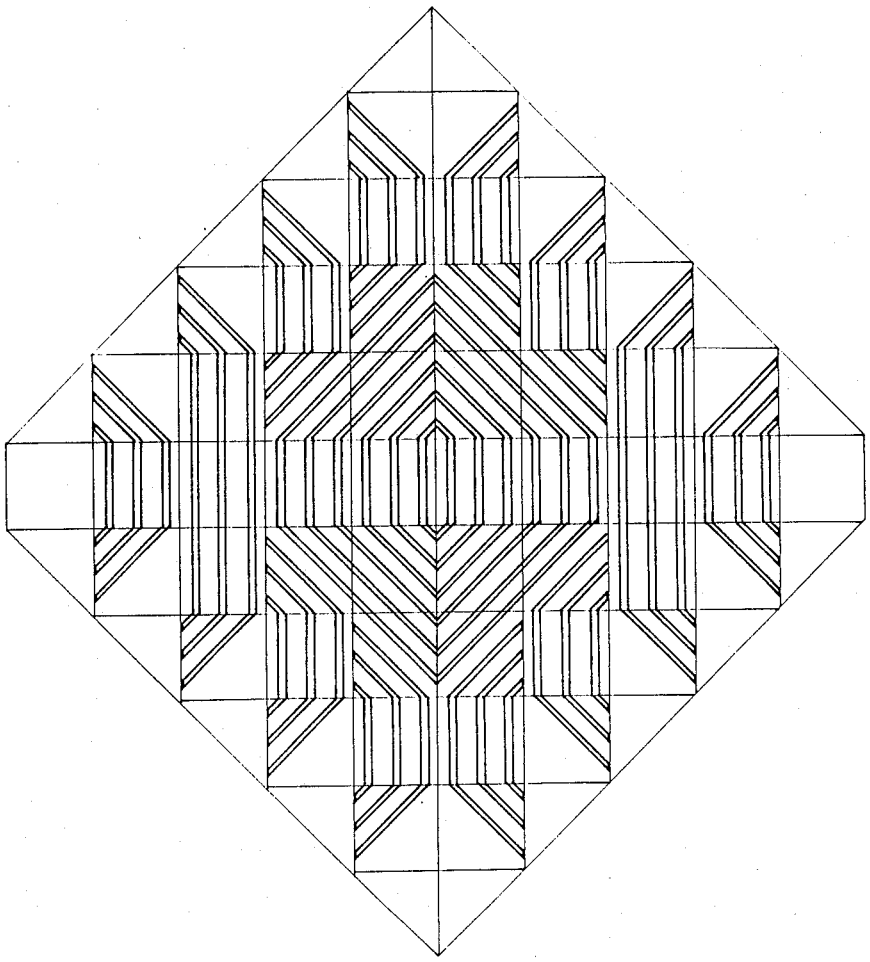
Figure 24:
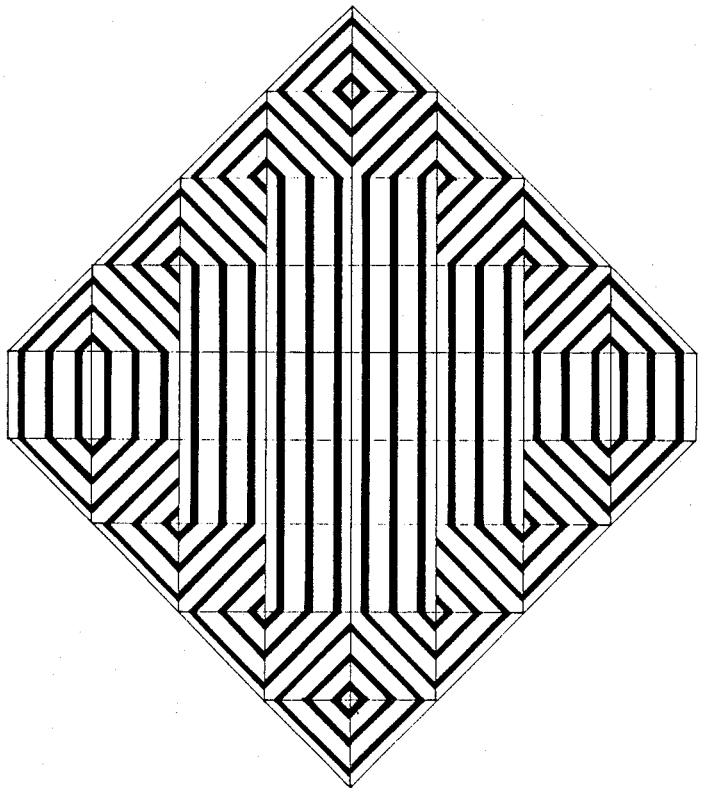
Figure 25:
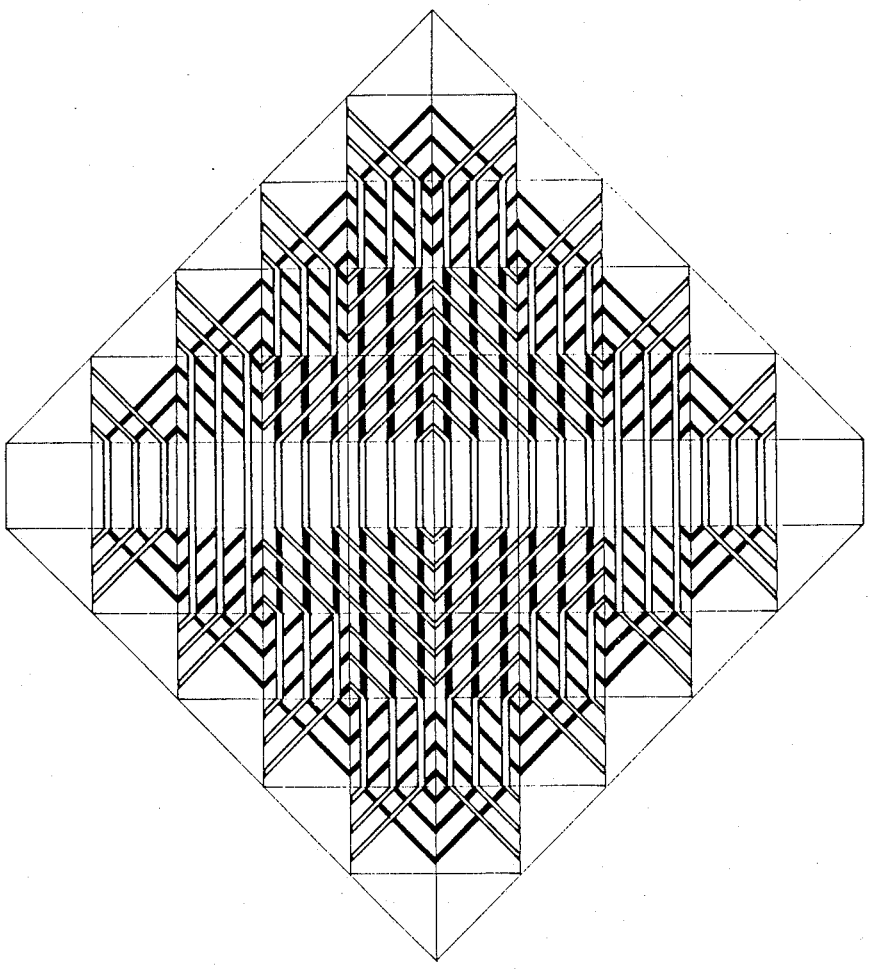

FIGS. 23, 24 and 25 illustrate the way to obtain a kinetic stained glass window. The panel made by fitting together individual modules of the invention shown in FIG. 23 is composed having such modules built from a transparent material while the panel shown in FIG. 24 is made from modules built with opaque material. Upon superimposing the panel of FIG. 23 above panel of FIG. 24, a kinetic stained glass window is obtained, as shown in FIG. 25, having a sort of network spaced apart from the bottom wall or panel represented by the opaque panel of FIG. 24.

Figure 26:
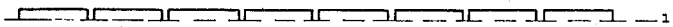

FIG. 26 is a schematic view showing the way in which the individual modules of the present invention are fitted together in the same plane, whether it be vertical or horizontal.

Figure 27A:
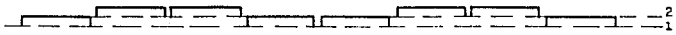
Figure 27B:
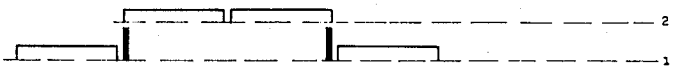

FIGS. 27*a, b* are schematic views illustrating the way to fit together the individual modules of the invention when some of the modules are placed in an upper plane. FIG. 27*b* shows a detailed illustration of this kind of grouping for the modules.

Figure 28:
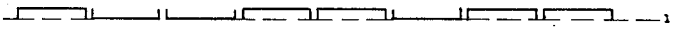

FIG. 28 is another schematic view, illustrating another way to fit together the individual modules of the invention, with the panel thus formed having some of the modules inverted.

Figure 29:
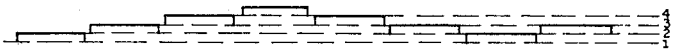

FIG. 29 is another schematic view in which the modules of the invention are fitted together in several different upper planes, like a step pyramid.

Figure 30A:
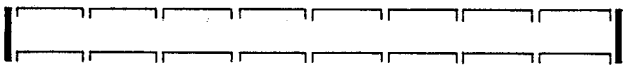

FIG. 30*a* illustrates a form to obtain kinetic effects by means of superimposing of panels made by fitting together of individual modules as per this invention, having their faces upwardly oriented.

Figure 30B:
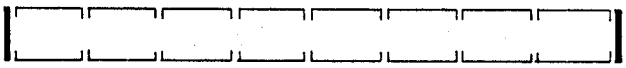

FIG. 30*b* is a schematic view showing another form to obtain kinetic effects, having in this case the individual modules facing each other integrating a complex of framed panels.

FIG. 31 is a schematic view of a panel formed fitting together individual modules of the present invention having some modules placed in inverted form and in a lower plane.

FIG. 32 is a schematic illustration of a panel made by fitting together individual modules of the invention in two different planes with those placed in the lower plane being a combination of modules, some of which have their upper faces upwardly oriented and some downwardly oriented, while those placed in the upper plane disposed upon the inverted or downwardly oriented, in frame-like fashion.

FIG. 33 is a schematic view of a panel having its integrating modules disposed in combining different planes, inverted modules and frame-like modules.

FIGS. 34*a–h* show several top views schematically illustrating several ways to form volumetric groupings for manufacturing lamps, mobiles, sculptures, additional furniture, decorative objects and several adornments.

Figure 35:
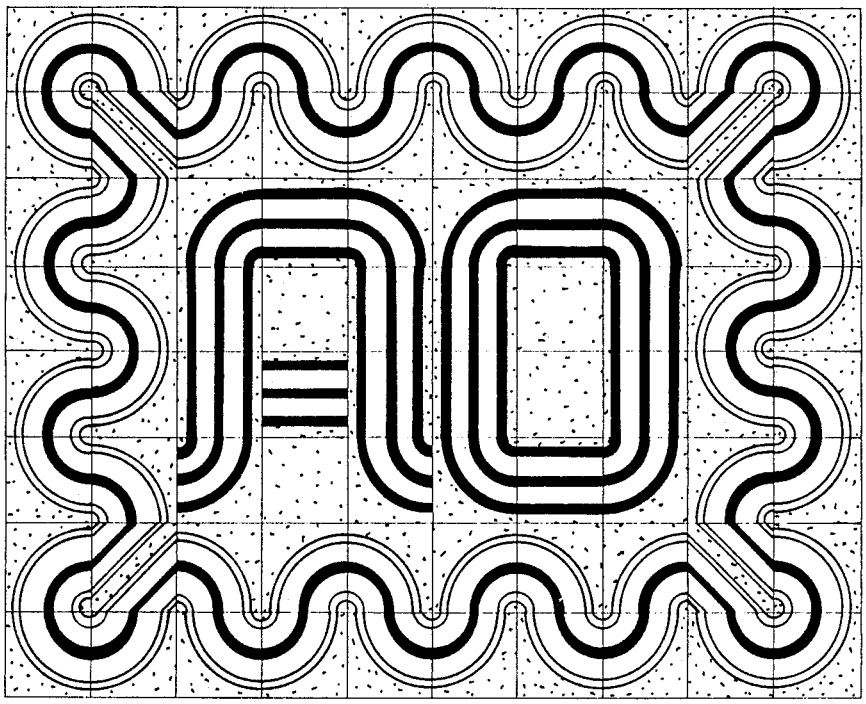
Figure 36:
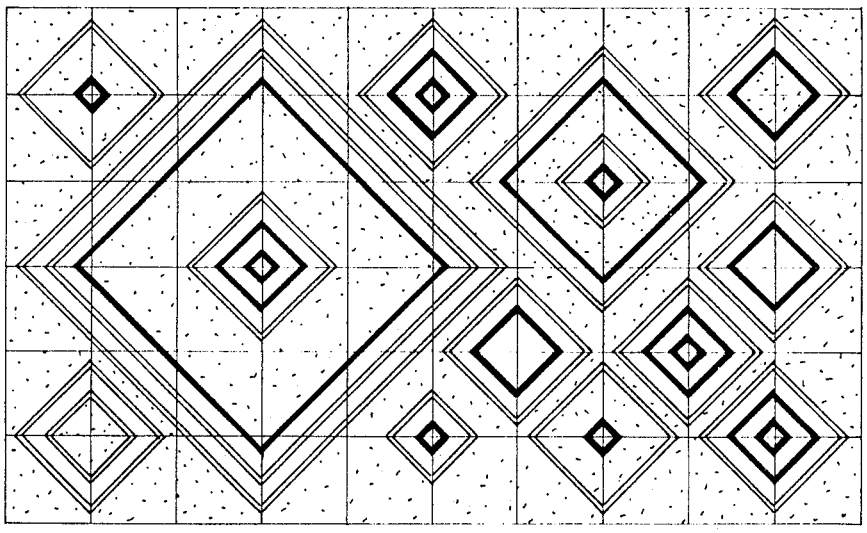

FIGS. 35 and 36 illustrate several designs for decorated floor straps, obtained by fitting together the individual modules of the present invention.

Figure 37:
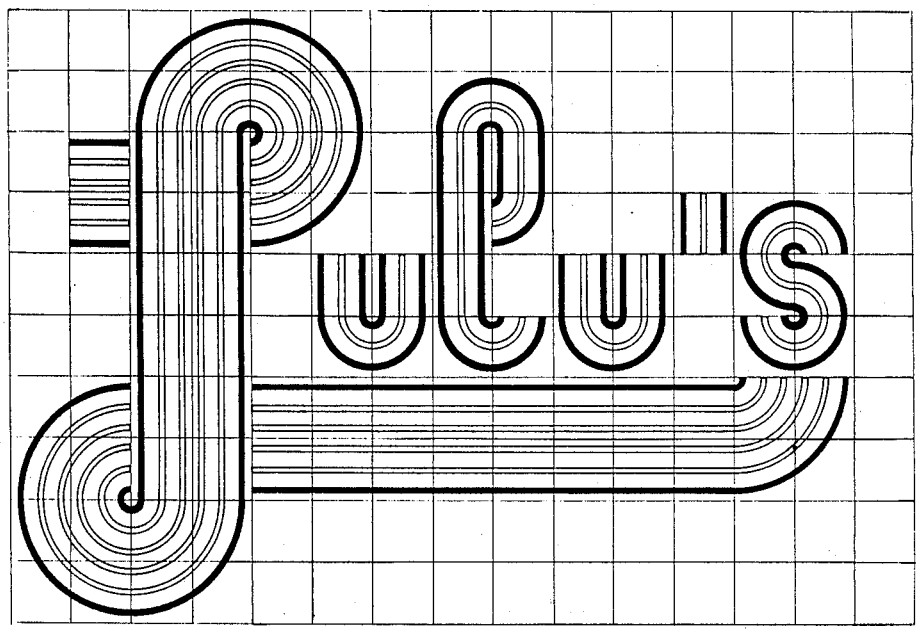

FIG. 37 shows a design of a signboard, made by fitting together individual modules of the invention.

Figure 38:
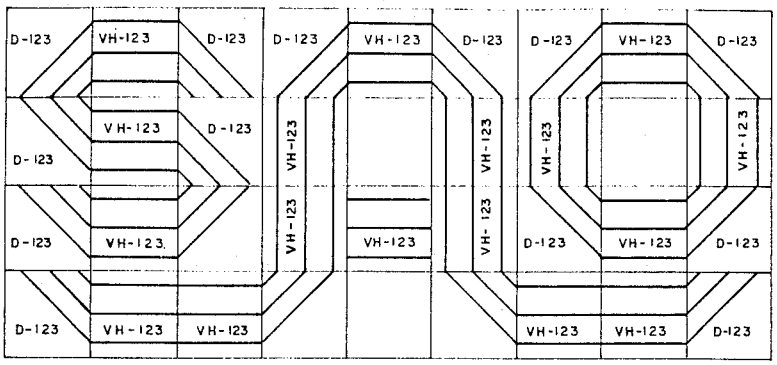
Figure 39:
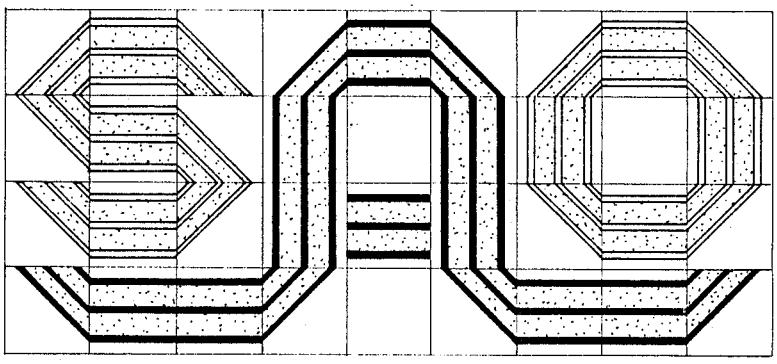
Figure 40A:
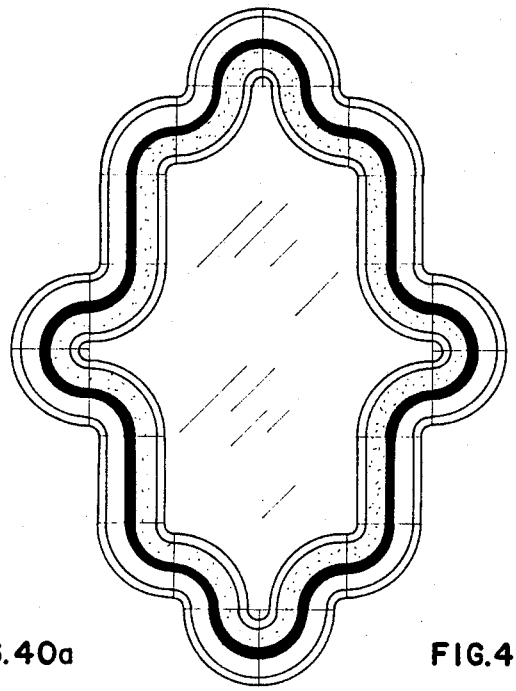
Figure 40B:
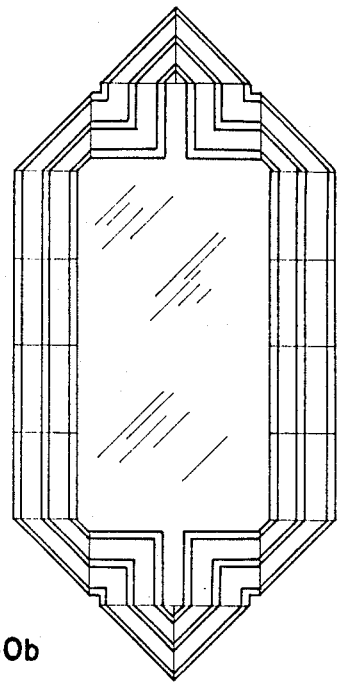
Figure 40C:
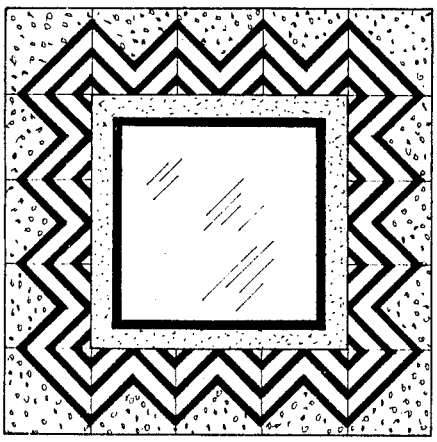
Figure 40D:
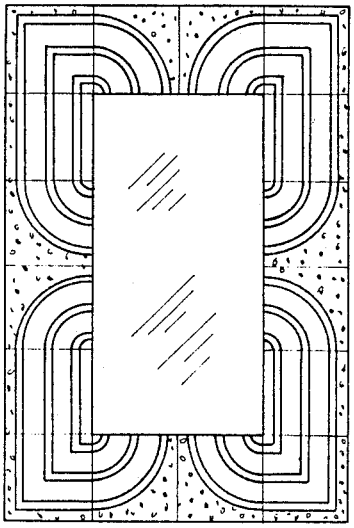

FIGS. 38 and 39 illustrate respectively the development of the design of a logotype and its final realization by fitting together individual modules of this invention.

FIGS. 40*a–d* several possible designs for mirror frames obtained by fitting together individual modules of the invention.

Figure 41B:
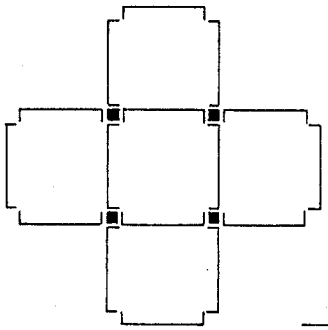
Figure 41A:
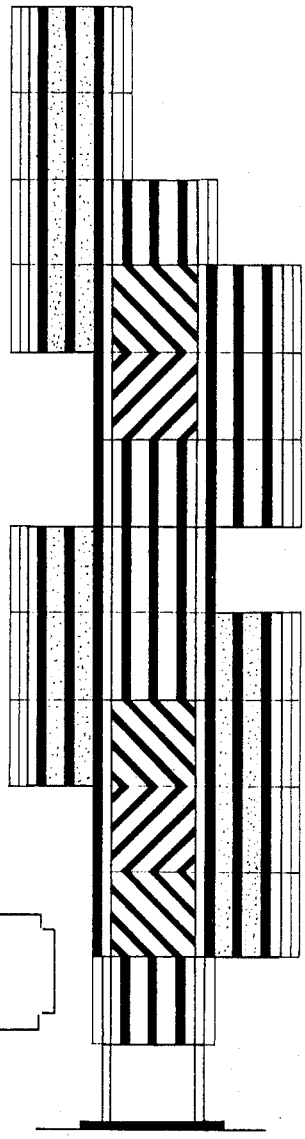

FIGS. 41*a* and 41*b* illustrate, respectively, an elevational side view and a top view of a sculpture intended to be placed in an inner space.

Figure 42A:
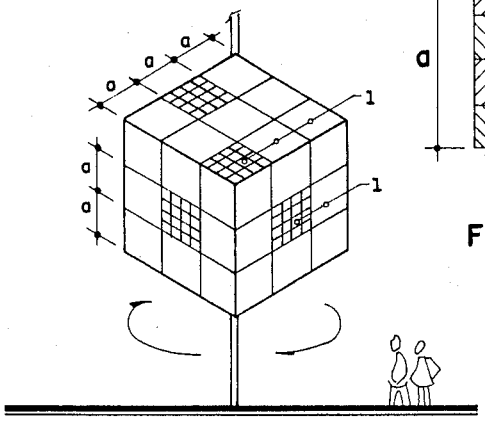
Figure 42B:
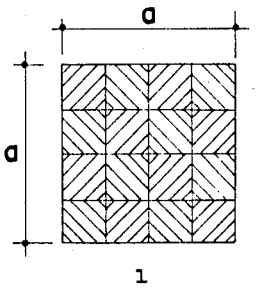

FIGS. 42*a* and 42*b* illustrate, respectively, a front view and a top view of a sculpture intended to be placed in an outer space.

Figure 43A:
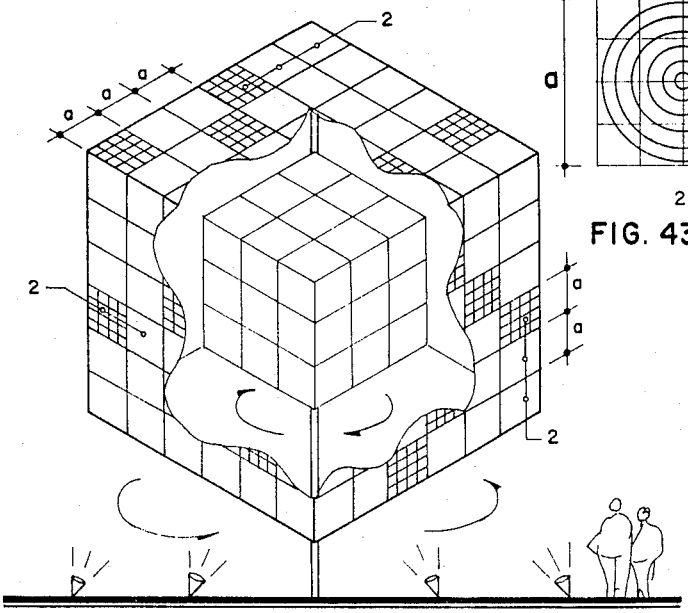
Figure 43B:
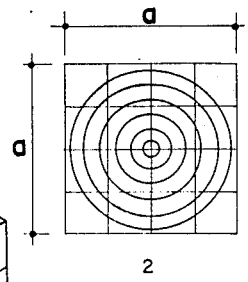

FIGS. 43*a* and 43*b* illustrate another sculpture intended to be placed in an outer space, which as opposite to the sculpture shown in FIGS. 42*a* and 42*b* is gyratory. A variation of this type of sculpture is one concentrically composed, with the enclosing sculpture being transparent while the enclosed being opaque. Another variation would be that the latter composed sculpture has opposed direction of rotation, in other words, while, for instance, the enclosing one rotates toward the right side, the enclosed one rotates toward the left side. Also, a light system could be included either internal or external or both.

Figure 44:
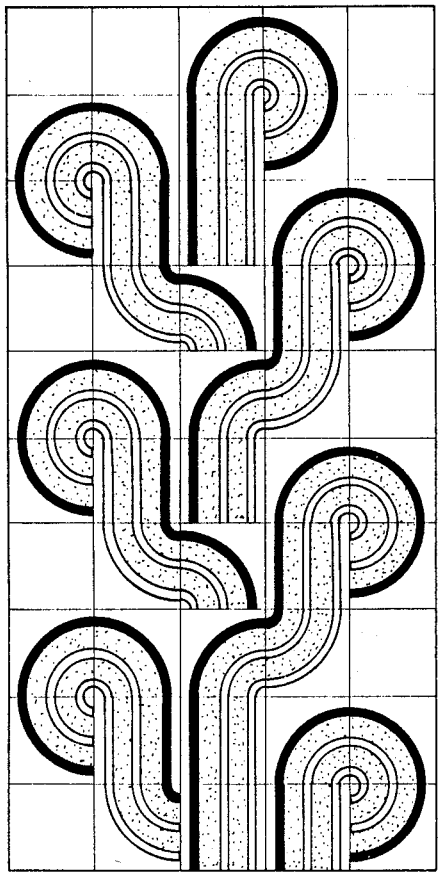

FIG. 44 is a view showing a design of a stained glass door or mural door. The individual modules fitted together to form the panel of the door can be opaque or transparent to obtain a stained glass door or a mural door. The motive decorating one side of the door, if so wished, could be repeated in the other side, or the other side could be decorated with a different motive.

Figure 45A:
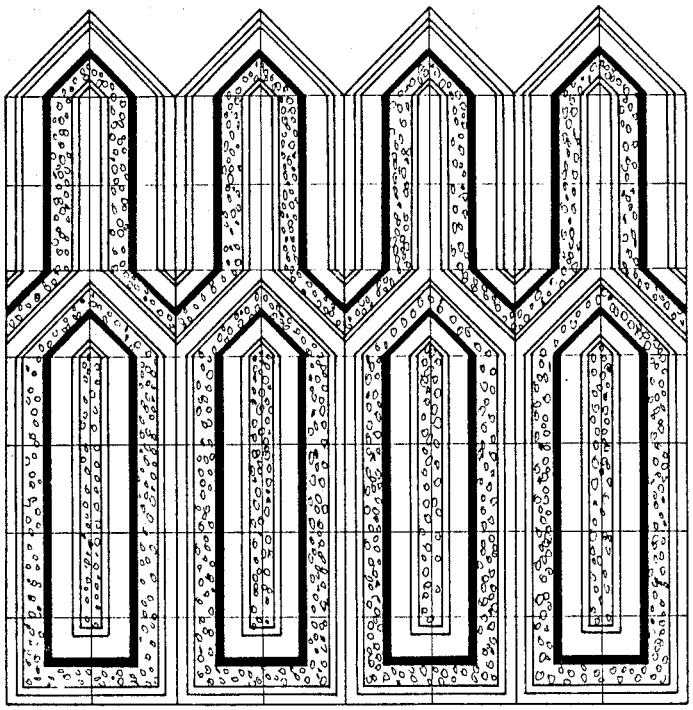
Figure 45B:
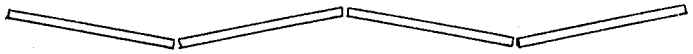
Figure 46A:
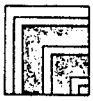
Figure 46B:
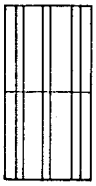
Figure 46C:
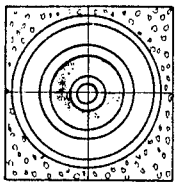
Figure 46D:
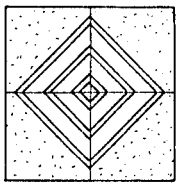
Figure 46E:
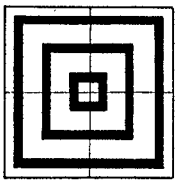
Figure 46F:
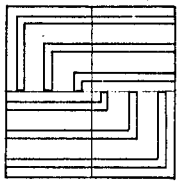
Figure 46G:
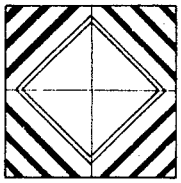
Figure 46H:
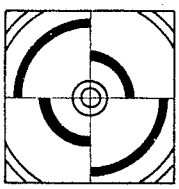
Figure 46I:
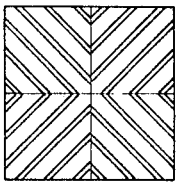
Figure 46J:
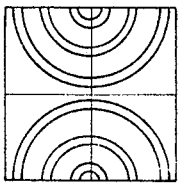
Figure 46K:
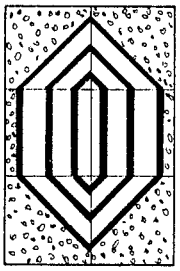
Figure 46L:
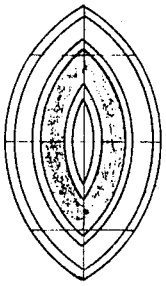
Figure 46M:
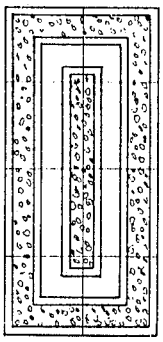
Figure 47A:
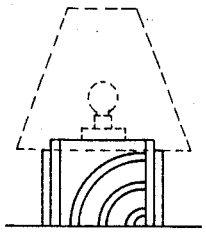
Figure 47B:
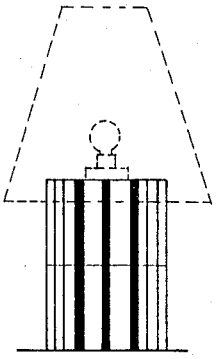
Figure 47C:
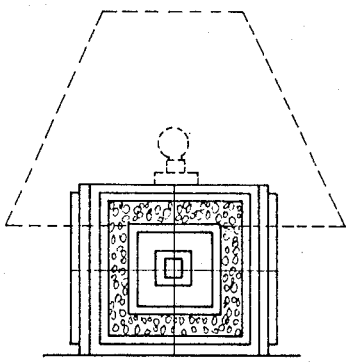
Figure 47D:
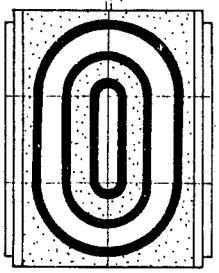
Figure 47E:
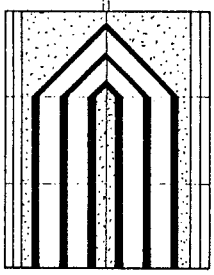
Figure 47F:
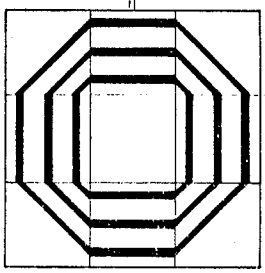
Figure 47G:
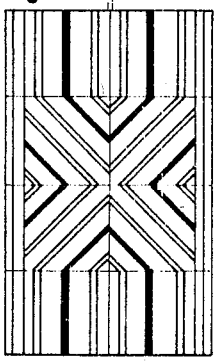
Figure 47H:
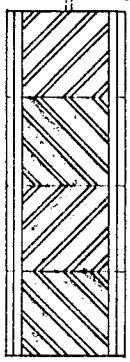
Figure 47I:
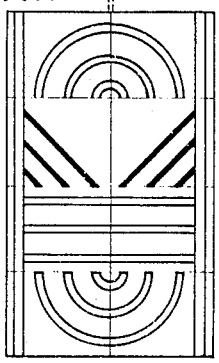
Figure 48A:
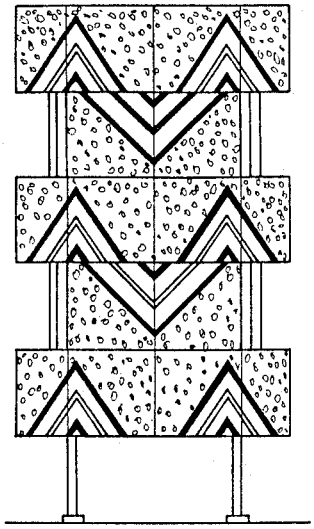
Figure 48B:
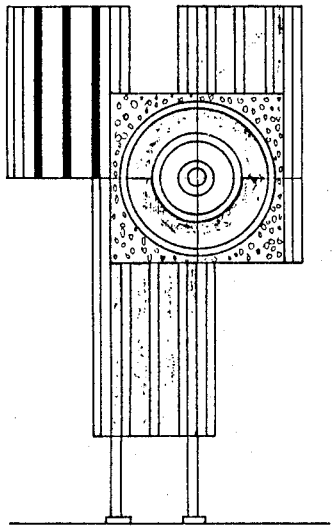
Figure 48C:
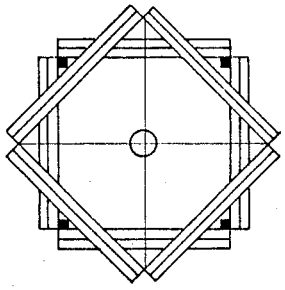
Figure 48D:
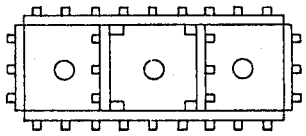

FIGS. 45*a* and 45*b*, respectively, are front and top views of a folding screen made by fitting together individual modules of the present invention.

FIGS. 46*a–m* represent several top view of several exemplary designs from the endless obtainables, of ceiling lamp screens, obtained by the fitting together of individual modules of the invention.

FIGS. 47*a–i* represent several elevational side views of table lamps, like that obtained by fitting together individual modules of the invention, being also there illustrated several ceiling lamps, formed in the same way with the individual modules.

FIGS. 48*a–d* show, respectively, elevational side and top views of two possible designs, of the endless obtainable of pedestal lamps.

Figure 49A:
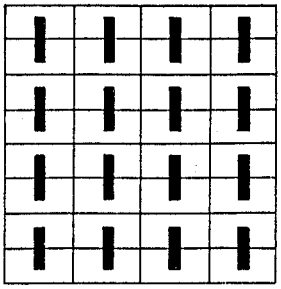

FIGS. 49*a, b* are plan and cross sectional views of a ceiling made by fitting together individual modules of the invention, intended to serve as a false roof and at the same time allow the illumination of the inner ambient covered by it, for which purpose the individual modules are made from transparent materials.

Figure 50A:
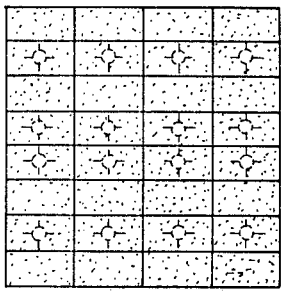
Figure 49B:
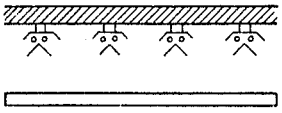
Figure 50B:
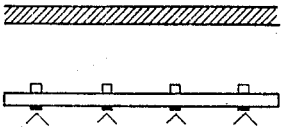
Figure 51A:
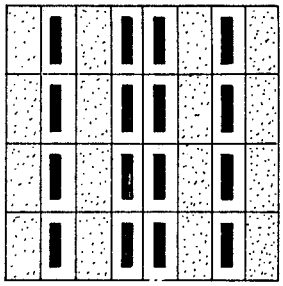

FIGS. 50*a, b* illustrate schematical views similar to FIGS. 49*a, b,* but in this case the individual modules or groups of modules coinciding with the light spots are transparent, while the rest are opaque. A variation of this kind of ceiling consists in the individual modules coiciding with the light spots are perforated, permitting them to hold individual lamps, in which case none of the modules would be transparent FIGS. 51*a, b* are schematic views similar to FIGS. 49*a, b* and 50*a, b,* in which the individual modules, or groups of modules, coincident with the light spots are transparent and the remaining are opaque.

Figure 52A:
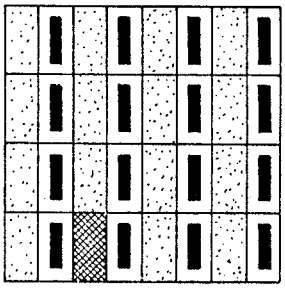
Figure 51B:
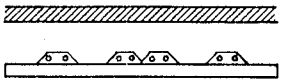
Figure 52B:
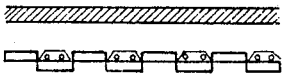

And FIGS. 52*a, b* are schematic views similar to previous figures, in which the ceiling covering the roof has the individual modules or groups of modules, transparent when coinciding with the light spots, while the remaining are opaque, but having the particularlity that the transparent ones are projecting, in other words, they are in a lower plane.

DETAILED DESCRIPTION OF PREFERRED EMBODIMENTS

To form decorative or artistic panels, the system of this invention provides an endless plurality of individual modules which can be fitted together, having each in their upper faces different geometrical forms, disposed in two planes or levels, with those being in the upper plane conforming high reliefs, while those being in the lower plane, or the plane itself of the upper face of the module, adopting geometrical configurations similar to the former conditioned by the side faces of the high reliefs, to form in combination the pictorial background of the geometrical representation. Both geometrics in high relief and plane, similar or different, are reciprocal and coicident with geometrical figures, similar or different disposed in other modules, so that they can be combined. This coincident combination determines that the combined high reliefs of a plurality of individual modules fitted together conform the total geometry in high relief of the figure that the artist wants to represent, while the lower combined plane defines the pictorial background.

Figures 8A, 8B, 8C, 8D, 8E, 8F, 8G, 8H, 8I, 8J, 8K, 8L, 8M, 8N, 8O, 8P, 8Q, 8R, 8S, 8T, 8U, 8V, 8W, 8X, 8Y, 8Z:
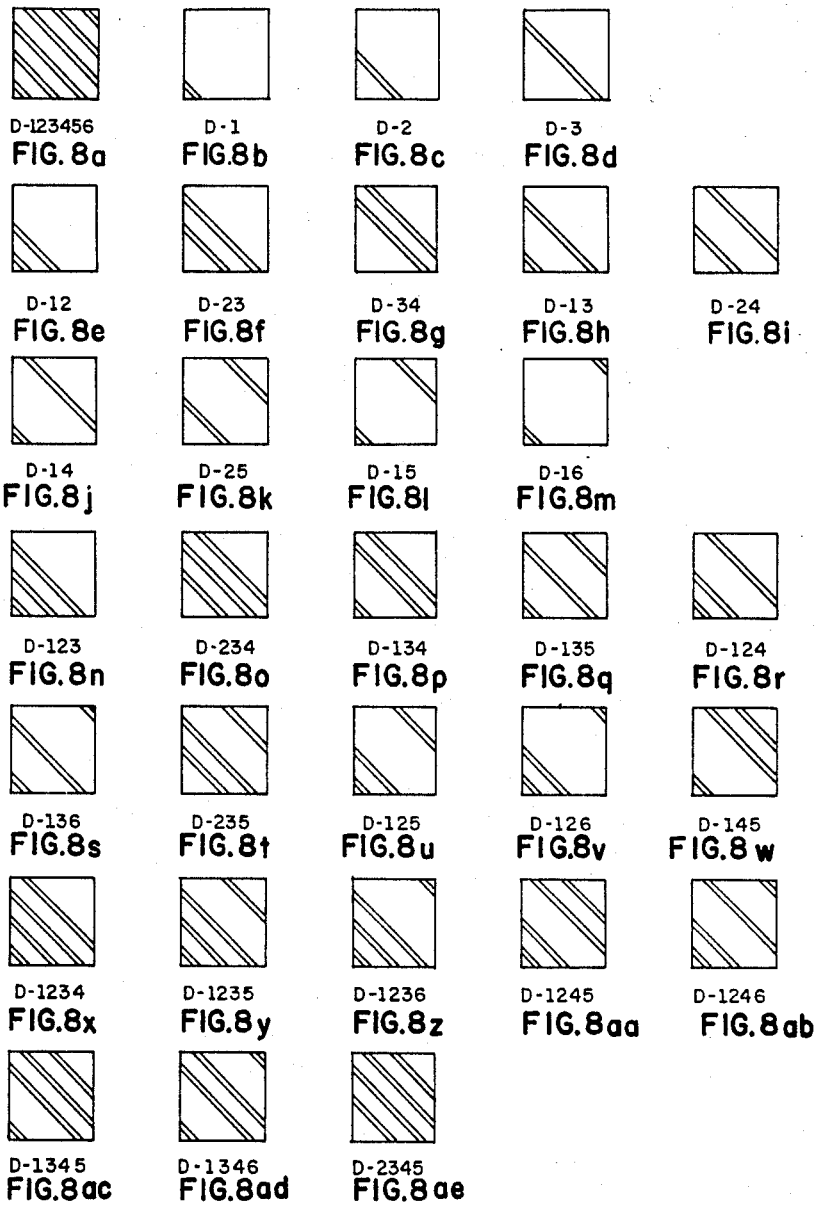
FIGS. 8*a–ae* are top views of individual modules, similar to FIGS. 6 and 7, but having their portions in high reliefs diagonally disposed at approximately 45 degrees.
Figure 10:
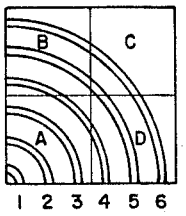
Figure 9A:
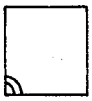
FIGS. 9*a–af* are similar to FIGS. 8*a–ae*, but their portions in high relief defining circle arcs, having separation ratios between them similar to those existing between the portions in high relief shown in FIGS. 6, 7 and 8, but with the characteristic that the curvature of the arcs increase as every arc is more distant from the angle of the module, next to the center of the circumference. This is due to the fact that it has been determined that for the best fulfillment of the system of the invention the portions in high relief in curved form should be provided as curve sections of a quandrant of a circle. Observing FIG. 10, which shows portions in high relief forming concentrical quandrant of circles, it is seen that every arc section comprised in each module A, B, C and D, can by itself or in concentrical combination, in different locations or separation ratios, form the curved sections of the modules shown in FIGS. 9*a–af* to provide individual modules having their high reliefs in curve form with different curvatures, sufficient to cover a wide scale of different curves, needed by any artist, architect or decorator to carry out their designed figures.
Figure 9B:
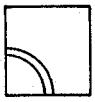
Figure 9C:
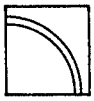
Figure 9D:
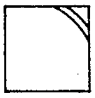
Figure 9E:
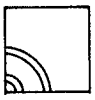
Figure 9F:
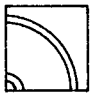
Figure 9G:
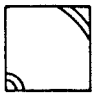
Figure 9H:
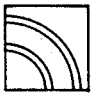
Figure 9I:
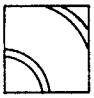
Figure 9J:
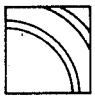
Figure 9K:
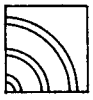
Figure 9L:
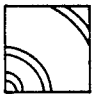
Figure 9M:
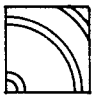
Figure 9N:
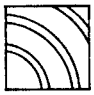
Figure 9O:
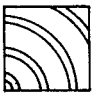
Figure 9P:
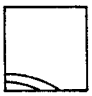
Figure 9Q:
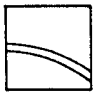
Figure 9R:
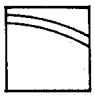
Figure 9S:
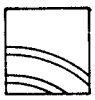
Figure 9T:
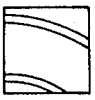
Figure 9U:
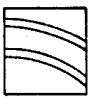
Figure 9V:
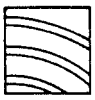
Figure 9W:
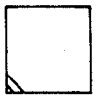
Figure 9X:
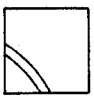
Figure 9Y:
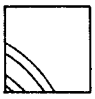
Figure 9Z:
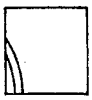
Figure 9A:
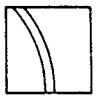
Figure 9A:
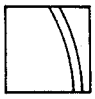
Figure 9A:
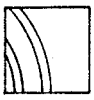
Figure 9A:
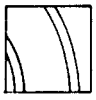
Figure 9A:
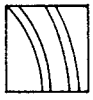
Figure 9A:
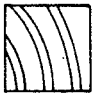
Figure 11A:
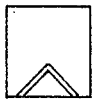
FIGS. 11*a–o* are top views showing a plurality of individual modules illustrating their portions in high relief having forms of vertices of equilateral triangles, some of them individually, while other are in concentric combination. In some instances, the portions in high relief only represent sections of the perimeter on both sides that converge to form a vertex.
Figure 11B:
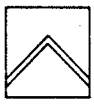
Figure 11C:
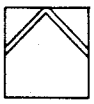
Figure 11D:
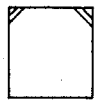
Figure 11E:
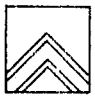
Figure 11F:
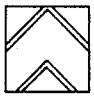
Figure 11G:
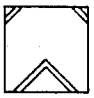
Figure 11H:
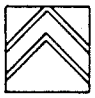
Figure 11I:
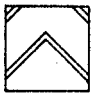
Figure 11J:
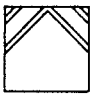
Figure 11K:
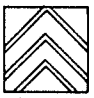
Figure 11L:
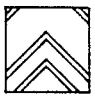
Figure 11M:
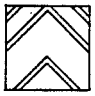
Figure 11N:
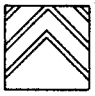
Figure 11O:
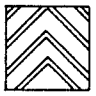

When manufacturing each individual module, it is to be taken into account that the geometrical axis of both geometries, in high relief and the lower plane be coincident with the geometrical axis of the geometries of the other modules, having or not equal geometrical configurations. Therefore, when fitting together a group of individual modules of the invention to form a decorative or artistic panel, the contour represented by the high reliefs in combination is continuous, with the high relief in each module forming sections of the total contour. Likewise, the pictorial background of the decorative or artistic panel constitutes a similar continuous surface or plane, defined by the coincident union of the lower planes of the combined modules. For instance, when a given section of the designed panel has a straight and vertical configuration in high relief, in the proper place is disposed to represent it, and individual module having its portion in high relief with such a configuration, for instance, an individual module as the one identified with reference VH-2 in FIG. 6*b.* If next section is curved one, to the first module is fitted together one having its portion in high relief configuring a circle arc, with the appropriate curvature, such as the one identified as CA-2 in FIG. 9*b,* and given the required orientation to the curve, as per the design. If next section of the design has a straight diagonal line, the individual module fitted together in the panel in formation should have its portion in high relief with same configuration, such as the module D2 in FIG. 8*b.* And so on until completing the entire figure to be represented in high relief, so that each high relief in each module represents only a given section of the total figure of the panel so formed. The same occurs with the pictorial background, the individual lower planes of every module are joined concidentally to form the total pictorial background of the decorative or artistic panel. Of course, there will be the need in certain places to use individual modules having their upper faces plains or flat, such as the individual module shown in FIG. 5, especially in those places where there is not foreseen or designed the placement of a high relief.

DETAILED DESCRIPTION OF PREFERRED EMBODIMENTS OF INDIVIDUAL MODULES

For a better understanding of the present invention, preferred embodiments of the individual modules of the invention will be described, which individual modules permits upon their combination to carry out the total composition created in the mind of the architect, artist or decorator. These preferred embodiments are described only in an exemplary way without limiting it, taking into account as was already discussed previously, that the possibility to provide individual modules which can be fitted together having different geometrical forms in high relief, as well as the different combinations of such geometries, is endless.

Reference will be made to the annexed drawings, a brief description of which was already given, which drawings form integral part of this specification and which further will supplement it in case of any omission incurred during the description.

To facilitate the understanding of the specification, the different parts or sections of the invention will be signaled by means of reference members which will be repeated through the diverse figures to indicate the same section or parts.

As was previously discussed, the individual module of the present invention may have endless geometrical forms in high relief in their upper faces, being likewise endless the combinations that can be obtained with such geometries. However, in order to facilitate the explanation and description of the invention, and particularly the configuration of the individual modules, hereinbelow reference will be made in detailed description to an individual module which can be fitted together to similar ones, having its portions in high relief straight, parallel and space apart, such as the individual module illustrated in FIG. 6*e,* in a top view, which is identified with the reference number VH-123 in the drawings.

The individual module VH-123 seen in FIG. 1, 2, 3, 4 and 6*b* is a polyhedral geometrical body 1 and, more specifically, is a right parallelepipel body, having quandrangular base, conforming a box 2 with its upper and lower faces larger than the rest with such a lower base or face being free while the upper one has a plurality of portions in high relief 3, conforming parallelepipel or rectangular bases, being parallel and spaced apart. In general terms, box 2 is a hollow polyhedral with its lower face free or open, with its upper face having two different planes or levels, one determined by the upper faces of the portions in high relief 3, and the other, lower relative to the first one, formed by the plane or upper surface of the box 2, such high relief portions also being hollow and communicating with the interior of box 2, through their respective lower free or open faces.

The portions in high relief 3 are placed in parallel and spaced apart positions upon said upper face, being parallel and longitudinally aligned to the median line, one of such high relief portions being central and which geometrical axis is coincident with the median line, while the other two are lateral to it but remaining separated from the lateral edges of box 2.

The portions in high relief 3, therefore, define an upper face or base of said module VH-1223 having its surface divided in several spaced apart sections and in two different planes. The spaced apart sections of the upper face are constituted by the upper faces of the portions in high relief 3, while the spaced apart sections of the lower plane are formed by the sections of the upper face of box 2 existing between the high relief portions 3 and the side walls of the internal high relief section. The central and lower section 7 and 8 are confined, longitudinally and laterally, by the inner faces 5' and 6' of the high relief portions 5 and 6, and the two lateral longitudinally faces 4' and 4'' of the central high relief portion 4, while the lower lateral sections 9 and 10, are limited by their inner longitudinal sides with the outer faces 5'' and 6'' of the high relief portions 5 and 6, respectively, being the latter narrower than the central ones 7 and 8.

The sections that form the upper spaced apart plane, that is to say, the upper faces of the high relief portions 4, 5 and 6, are longitudinal and have respective perimetrical raised borders 11 enclosed them in frame-like fashion, which raised border are characterized by having short height, defining an internal space in cell-like fashion, which are parallelepiped of rectangular base, open by their upper faces, which functions and purposes will be discussed later on.

The spaced apart sections of the power plane formed by the central longitudinally sections 7 and 8 and laterals 9 and 10 also are equipped with similar cells, having their raised borders 12, which are identical to the raised borders 11 but enclosing in this case only those sides of the cells that are not abutting with the side faces 4', 4'', 5', 5'', 6' and 6'' of the high relief portions 4, 5 and 6.

The cells defined in the upper faces of the high relief portions 4, 5 and 6, having their perimetral raised borders 11 and those defined by their raised borders 12 in the lower plane, allows that these spaces can be filled, through casting, with plastic materials, such as pigmented or colored polymers, epoxycal products, resins, etc., having equal or different textures and colors. Evidently, and in accordance with the artistical or decorative work to be carried out, the material employed to fill, for instance, the upper cell in the upper faces of the high relief portions, might be equal to those used to fill the cells in the lower plane, or they may be other materials having different characteristics, colors or textures. Also, it could be possible to apply, through adherence or by casting, a material within the cells of one of the two planes and leave the cells of the other plane empty, or leave both empty. These possibilities and alternatives permit to obtain a work of art or decorative figure, as well as utilitarian elements, having besides the novel aspect in high relief, means to achieve a chromatism with endless possibilities for hues and mixtures, with the artist, architect or decorator being able, likewise to use warm and cold colors, to raise or diminish the projecting or recessing formations of the individual modules or panels formed with such modules, to stand out or attenuate the ornamental high reliefs.

In this regard, it should be noted that the short height of raised borders 11 and 12 limits the height of such fillings made either by casting or adherence. However, the central cells in the lower central sections 7 and 8, when the user so wishes, or when it is required by the design, could be filled until reaching the level determined by the raised borders 11 that enclose the upper cells defining thus a central section in high relief of greater area. Also, it is possible to fill the power lateral sections 9 and 10, obtaining then a sole even surface for special applications or effects, or to be used as floor tile for decorated floors. To this purpose, it should be necessary to provide standard means to close provisionally, in frame-like fashion, those open or free ends of the side faces of the modules, when filled individually.

The individual modules of the invention having their high relief portions representing different geometrical figures to those just described in respect to the specific example of the module VH-123, are identical in all respects to the latter module, with the only exception being the geometrical configuration of their high relief portions, the number of them disposed in the upper faces of box 2, and the relation for their location relative to said upper face of box 2 and the other high relief portions, when there exists more than one. In FIGS. 5 through 11 of the annexed drawings illustrate several examples of the endless possible to obtain, which assist to clarify these concepts. The individual modules indicated by the reference numbers VH-1, L-1, D-1, CA-1 and DD-1, in FIGS. *6a*, *7a*, *8b*, *9a* and *11a*, are examples of the different geometrical configurations of the high relief portions, which can be fitted together to form decorative or artistic panels and, in combintion, constitute a general motive. The remaining individual modules shown in the same figures of the drawings, are examples of the number of the high relief portions disposed upon the upper faces of the individual modules, as well as the variant location relationship of such high reliefs.

FIGS. 1–4 show a border or raised element 12 which is an essential element of the present invention. The remaining figures are used primarily to show various panel designs which can be formed from the modules of the present invention. While the raised element 12 is not explicitly shown in all of these figures, it would be included in the final panel designs.

DESCRIPTION OF A SYSTEM FOR DESIGNING DECORATIVE OR ARTISTIC PANELS TO BE CARRIED OUT USING INDIVIDUAL MODULES OF THE PRESENT INVENTION

To design a decorative or artistic panel, having figures in high relief, to be made using the individual modules of this invention, the architect, artist or decorator can continue using the standard method and means to sketch and draw his project, bearing only in mind that the axis of the geometries in high relief and at a lower plane of the individual modules, be coincident, in order that they represent in the final panel continuous geometries.

However, to facilitate the design when using the individual modules of the present invention, it is provided a design system that facilitates greatly the labor to be effected by the artist. Thus system consists in providing sheets having therein printed reticula composed by squares and rhombuses, which sides are equipped with three guide dots, aligned with the guide dots of all the sides of all the remaining figures; the square reticula have the guide dots aligned between themselves, both invertical and horizontal senses, while in the rhombuses reticula the alignment of the guide dots is obliquely divergent.

Using one of these reticular, such as that illustrated in FIGS. 19 and 20 of the annexed drawings, the artist or architect draws the total panel design that he wishes to represent by means of the individual modules of this invention, which drawing is easily effected as every square or rhombus represents an individual module and every guide dot represents the geometrical axis of every high relief portion disposed in the upper face of the modules.

In accordance with the invention, as previously discussed, the individual modules can be manufactured having one or more high relief portions in their upper faces, as well as individual modules with plain upper faces to integrate or complete the pictorial background of the panels.

An examination of the reticula shown in FIGS. 19 and 20 demonstrates the facility to obtain a design with their help. It would be sufficient to draw lines between the guide dots of one particular individual module, representing the high relief configuration desired, and then prolong them to the guide dots of the adjcent individual module having the same design and orientation or having different design and orientation until the final panel has been completed.

DETAILED DESCRIPTION OF DECORATIVE AND ARTISTIC PANELS OBTAINED BY FITTING TOGETHER INDIVIDUAL MODULES

Once the artist, architect or decorator has fulfilled his design of the final panel with the system for designing previously described, and in order to elaborate the designed panel, he will dispose individual modules having their high relief portions with the geometrical configurations similar to the design, fitting them together, representing every section until the final figure is obtained.

The individual modules are fitted together side to side, in other words, the side faces of a module are joined with the side faces of the adjacent modules. By means of a cement or adhesive composition applied to the adjoining faces they are kept together, taking care that the geometrical axis be coicident, although this fact does not require special attention because such coincidence is given and foreseen previously during design and manufacturing of every individual module.

The union by adhesion of side faces of box 2, as well as the minor faces of the high relief portions, confers to the final panel rigidity and resistance from the structural point of view, while at the same time the back edges of said side faces form a rear reticulum which serve to facilitate the adhesion of the panel to an existing will, as schematically shown in FIG. 16 or to an structure specially made to support the panel.

For instance, for making the the simple panel illustrated in FIG. 12, previously designed by means of the sheets having printed reticula shown in FIG. 19, and individual module VH-123 will be used for vertical and straight sections (reference should be made to FIGS. 6*e*, 12 and 13). If these sections were longer than illustrated, it would be necessary to employ several modules VH-123 fitted together until the required length is obtained. To represent the curved sections, use will be made of one or several modules CA-123 (FIGS. 9*k*, 12 and 13); for diagonal sections one or more modules D-123 will be disposed (FIG. 8*n* and 13), and the broken or mixed sections will be represented by means of one or more modules L-123 (FIGS. 7*g* and 13).

The result is a decorative or artistic panel having figures in high relief, obtained by means of fitting together in coicident relationship the high relief portions of the individual modules, with the pictorial background being integrated by the concomitant union of the lower planes of every module.

Once completed, the panel, as shown in a top view in FIG. 13 and in a perspective view in FIG. 13, if the design so requires, the cells formed on the upper forces of the high relief portions and on the lower planes are filled with any of the materials previously discussed, or filling only the cells on the lower planes leaving empty those existing on the upper planes or faces of the high relief portions or vice versa.

The cells can be filled with other materials, having equal or different textures, being opaques or particulates, such as cement, concrete, granite, graulite, etc. In FIG. 14 there is shown another design of a panel achieved by fitting together individual modules of the present invention, in which there has been used diverse filling materials, like those just mentioned. For instance, for the pictorial background granite or granulite was used, while the cells existing on the upper faces of the high relief portions were filled with a plastic, by means of casting, melting or adherence application. Also, in FIG. 15 there is shown another panel destined to be used as a socle, in which a particulate material was utilized to cover as a filling the pictorial background.

Besides the represented design or work of art in the final panel obtained, the perimeter of every panel may have different geometrical forms, or their combinations, such as the examples illustrated in FIGS. 17*a–n* of the annexed drawings. To obtain such perimeters or contours not having straight sections neither right angles, it would suffice to section those modules abutting with the perimeter itself to fulfill the desired forms.

On the other hand, while the individual modules of the present invention are made in order that the geometrical axis of their geometries be coincident, so as to obtain continuous geometies when joined to either, the artist's creativity may demand the realization of panels in which such circumstance does not take place. If FIG. 18 there is shown a panel which high relief portions are not coincident. This fact can be obtained through several ways. For instance, the third upper part of the panel of FIG. 18 is integrated by three individual modules fitted together side to side having their high relief portions with different configurations and with their axis oriented at random. The middle part of the panel is confomed having two individual modules in the central part while at the sides thereof there are two halves of sectioned modules, which in this particular case are not halves of the same module, having their geometrical axis also oriented at random, not having coincidence neither between themselves nor with the geometrical axis of the adjacent high relief portions. Finally, the lower third part of this panel, same as the upper third part, is formed by three complete modules, which in the case constitute a repeitive figure of the figure of the upper third part but, of course, they could be different.

PANELS HAVING DIFFERENT MODULES GROUPING

In FIGS. 27*a, b* and 33 there are illustrated diverse forms to achieve panels having some of their individual modules disposed in different planes or levels, or in combination with other modules. These diverse combinations permit to obtain panels with part of their surfaces in projected or recessed form, in several degrees, allowing the artist, architect or decorator to make stand out one or more zones in which he is interested, or adapted the panel to the total design of the room in which it is to be placed.

For instance, in FIG. 26 there is shown in the way to fit together the individual modules in the same plane or level, being it either a vertical or horizontal plane, while FIG. 27*a* is a schematical view illustrating a panel having some of its individual modules disposed in a lower plane.

FIG. 28 illustrates an example in which some of the individual panels are placed in inverted form, creating thus recessed area, relative to the general level of the panel. On the contrary, the panel shown in FIG. 29 has several projecting areas, because several of its individual modules are placed in several planes or levels disposed in progressive upper stages that in cross sectional view shows a staged pyramid silhouette.

Other ways to dispose the individual modules of the invention are illustrated in FIG. 30*a* and 30*b*, although in these two particular cases, they are really the way to superimpose complete panels. The panel of FIG. 30*a* is a composite panel, in which the upper one is spaced apart from the lower one. This arrangement permits to obtain kinetic effects, as will be discussed in detail in the next section.

In FIG. 30*b* there is shown another way to dispose a superimposed panel over other, being in this case interted the lower one, so that the modules are in a face-to-face relationship.

In FIG. 31, there is shown a panel similar to the one shown in FIG. 28, but in this example the inverted panels are in a lower plane. The panel in FIG. 32 illustrates a panel similar to the panel in FIG. 28, but having its panels that are inverted corresponding superimposed modules, in a frame-like fashion.

The panel shown in FIG. 33 is combined having in a first plane inverted modules while in an upper plane having inverted modules with some of the latter having modules in superimposed form.

A particular alternative as to the way in which the individual modules are fitted together or the panels previously formed by fitting together the individual modules are joined to others is illustrated in FIG. 34*a–h* in which the modules or panels are fitted together by their rear edges, obtaining in this way the conformation of polyhedral bodies, which besides presenting an external attractive appearance and/or artistic, define an inner space, in which diverse objects can be placed.

DETAILED DESCRIPTION OR PREFERRED EMBODIMENTS OF WORKS OF ART, DECORATIVE OR ARTISTIC WORKS AS WELL AS UTILITARIAN ELEMENTS, USING PANELS MADE THROUGH THE FITTING TOGETHER OF INDIVIDUAL MODULES OF INVENTION

Once panels have been formed using the individual modules of the invention, said panels can be disposed in several different forms, using them by themselves or in combination with other panels, or equal or different configurations, to achieve and fulfill the objects of the invention, previously related and discussed.

Hereinbelow follows in connection with the annexed drawings with special reference to FIGS. 21 through 52 detailed description of diverse works of art and decorative or utilitarian elements, integrated to architecture works, which can be obtained with the use of the panels, previously designed and made through the fitting together of the individual modules of the invention, and which serve both to complement the technical description given and to illustrate the explanations about configuration and assemblages, as well as to illustrate the endless possibilities for creation given to artist, architect and decorators, by means of the use of the individual modules, panels and systems of the present invention.

SIMPLE STAINED GLASS WINDOWS

Apart from the design obtained through the geometries disposed in two different planes or levels, and the color, hue and textures combinations, which provides the chromatic effect desired, and aesthetically pleasant, with the use of the panels it is possible to obtain simple stained glass windows, in which a sole filling material is utilized, casted or adhered, with the individual modules made from transparent or transluscent material, so that the external ligth or the environmental light when passing through it will, at the same time, illuminate the diverse sections of the panel, which can be multicolored or not, and project in the internal environment of the room where it is installed, a diffuse light blended with the color existing in the stained glass window. The outer architectural will be also enhanced by the stained glass window, due to its colors, its geometrical combinations and its high relief portions. FIG. 21 is a top view of a simple stained glass window, as the one described, made in accordance with these concepts, and in which was used as a sole filling material, for instance, colored polyester.

COMPOSITE STAINED GLASS WINDOWS

A composite stained glass window is shown in FIG. 22 of the annexed drawings, which is integrated by a panel made with the individual modules of the present invention, in which some special effects are obtained, by means of the use of filling materials having different origin and textures.

In this example the high relief portions which define the geometrical figures represented are filled with white granite pebbles, providing a rugged surface, while the pictorial background is filled with, through casting, melting or adherence, a platic material, such as polyester. In this embodiment the granite prevents the penetration of the light through the upper faces of the high relief portions, which can pass only through the pictorial background and the side walls of the high relief portions.

KINETIC STAINED GLASS WINDOWS

One of the most interesting and creative possibilities of this invention consists in the formation of stained glass windows having kinetic effects, characteristic which is additional to those already indicated, for the simple and composite stained glass windows, as it not only creates a pleasant ambient, due to effects of the controlled passing of the light through it but also constitutes a work of art or decoration integrated to the general architectural of the building, which impress pleasantly to the user and visitors.

In FIGS. 23, 24 and 25 there is shown the steps to be followed to elaborate a kinetic stained glass window, in accordance with the present invention. The panel shown in FIG. 23, for instance, is destined to serve as an upper panel, superimposed in spaced-apart relationship relative to the pictorial background, as a network. To this end, this upper panel is made from a transparent material. The panel shown in FIG. 24 is similar to panel of FIG. 23, which besides representing a different geometrical figure, with different orientations, is made indistinctly from a transparent or opaque material, as per the desired effect to be obtained from the pictorial background of the kinetic stained glass window. When the panel of FIG. 23 is superimposed upon the panel of FIG. 24, it is obtained the final stained glass window shown in FIG. 25. The combined high relief portions that form the upper panel, defines a network-like screen, not fixed directly over the lower panel, but in a spaced-apart relationship, which fact determines that when a spectator moves before the kinetic stained glass window obtains a vibration effect producing some perturbation in the retina, creating the sense of movement apart from the impression produced by the superimposition of color with different hues and tones.

MURALS

The panels made in accordance with the present invention finds particular application in murals destined to cover walls, etc., making it possible to beautify both internal and external ambients. To this purpose, the panels integrating a mural are placed as covering or coating on the walls, being fixed to the latter by means of conventional adhesive means, in such a way that the rear edges of the side walls, which form a rear reticulum in the rear part of the panels, remains firmly embossed in said adherence means.

Of course, the panels used as murals may have the mentioned characteristics in respect with the formation of panels having different groupings of the individual modules with projecting or recessed areas or both.

The murals also can be simple or composite, or have their geometries in two or more different levels or groupings, covered with a sole or different several colors or using material which textures are plain or particulate or having a combination of all these elements.

SOCLES

It is evident that the panels used as murals might also be used as socles, in place of the standard socles. For which application it would suffice to form panels with the individual modules of the invention having the special required dimensions for such a use or in any case sectioning the individual modules or some of them.

CEILINGS

In FIGS. 49 to 52 there are shown decorative ceilings made using the panels obtained by this invention. They can be made in order that they only cover, in screen-like fashion, the illumination systems located already in the roof, or to serve as a ceiling in spaced apart relationship and having at the same time holes that permit the pass of the light beams, or the positioning in such holes of the light lamps, as a support means.

Some of the ceilings so formed could be made having some row made from transparent individual modules, to allow the passing of the light through them, while some of the other rows of modules could be opaques. Also in this case it would be necessary to include structural support elements of standard construction.

DECORATED FLOORS

In FIGS. 35 and 36 there are illustrated straps for decorated floors, made in accordance with the invention by means of panels constituted by individual modules of the invention. In this particular use, the "straps" that determine the contour of the represented geometrical figures are defined by the high relief portions of the individual modules which fitted together form the panels used as tiles for the decorated floor. In the particular use, the cells existing both in the upper faces of the high relief portions and in the lower planes, are filled in such a way that each individual module integrates a body having its upper face in a uniform level, defined by the upper edge of the raised borders 11.

DOORS

An important application of the panels of the present invention resides in the manufacturing of decorated doors, which can constitute mural doors or stained glass window doors.

Mural doors can be made having a mural panel, as was already described in detail in the corresponding section disposed in a sole side of the door, with the other side being indistinctly a conventional material or another mural forming in this way a double mural door, representing the same motive or different, enabling the door to have a representation adaptable to each ambient.

The stained glass window doors can be made by disposing two panels of the invention in face-to-face relationship in a frame-like fashion, having the individual modules integrating the panels made from transparent or transluscent material. It is evident that the door can be made in order to consitute a kinetic stained glass window.

In any case, it would be required any additional and conventional structural element.

PARTITIONS

A possible use of the panels obtained with the individual modules of the invention is as partitions. When used as internal partitions, the panels can constitute only one face of the partition while the other could be a conventional material or both faces formed with panels of the invention. Here is valid what has already been said about the formation of the panels, their diverse forms of integration, as well a the conventional structural requirements.

FRONTAGES

The panel made with the individual modules of the invention can be used to cover, totally or partially, the facade of a building giving so the opportunity to obtain facades having decorative or artistic elements, formed by the high relief portions by themselves or in combination with diverse colors and materials, as was already discussed in respect of the panel formation.

The formation of the facades having transparent or transluscent panels will permit the obtention of different internal ambients, having decorative or artistic effects. These kinds of facades can be obtained by means of the utilization of the panels of the present invention in all of the forms, combinations and groupings previously related and explained, as well as all those forms that the creative power of the architect may devise, bearing in mind the possibilities to create offer by the individual modules of the invention.

When the total area of the facade is very large, the architect probably would prefer, taking into account the costs involved, to fill the cells using a sole material and color, but it is evident that it is possible to utilize all forms, combinations and groupings mentioned to make the panels of the invention.

LAMPS

In FIGS. 47*a–i* there are shown several examples, from the endless possibilities, illustrating some lamps obtained using the individual modules or panels of the invention. To make these lamps, the individual modules or the panels formed with them are fitted together in the same manner already explained in reference to FIG. 34, in other words, the panels and/or modules are fitted together by their rear edges to integrate polyhedral bodies. In this manner it is possible to make lamps having different geometrical configurations and having a very attractive external feature. In FIGS. 48*a–d* there are shown other lamps made using the individual modules and panels of the invention. Whenever the project relates to table, hanging or pedestal lamps, it would suffice to include in each particular case some conventional and standard elements to complete the construction.

Other obtainable lamps using the invention are the screens for wall lamps and room lamps, some of which possible designs are illustrated in FIGS. 46*a–m*. The examples shown in FIGS. 46*a–d* are of the kind destined for wall lamps, in other words, they represent the screen for wall lamps, while those shown under the references e through m are screens for roof lamps.

Also here is appropriate everything said about the individual modules and the panels obtained with them, bearing in mind that the screen for wall lamps and roof lamps can be made with transparent, transluscent or opaque materials, and can be obtained using also the combination or grouping discussed in order to make lamps as imitations of stained glass windows or kinetic windows.

SCULPTURES

Between the volumetric elements that can be made using the individual modules and panels of the present invention are the sculptures, both for internal or external placement. In FIGS. 41*a, b,* 42*a, b* and 43*a, b* there are shown some sculptures made using panels formed with the individual modules.

FIG. 41*a* is an elevational view of an internal sculpture, while 41*b* being a top view of the same sculpture. As illustrated in this example, the sculpture may have, besides the novelty surfaces represented in two different planes or levels, as determined by the geometries in high relief and the lower planes of the individual modules that in combination form the panels, projected and recessed areas obtained by superimposing individual modules and/or panels, in different planes, locations and faces.

The sculptures so obtained, could offer also the other novel features of the invention, such as the placement in different planes or levels of individual modules or panels, the filling of the upper and lower cells in uniform or alternative way, using equal or different materials, having equal or different textures, utilizing the superimposition of the individual modules or panels, and using conventional supporting structures.

The sculpture shown in FIGS. 42*a* and 42*b* has as an additional and possible characteristic, besides those already mentioned, that it constitutes a rotatory sculpture having its faces divided in several sections, each of which is integrated by a panel formed by means of fitting to other several individual modules of the invention.

On the other hand, the sculpture illustrated in FIGS. 43*a* and 43*b* is an alternative of the rotatory sculpture of FIG. 42*a, b* with the sculpture of FIG. 42*a* being disposed within another enclosing sculpture, which is larger, with both sculptures being able to rotate in opposed senses. These characteristics enable the obtention of special effects, such as kinetic effects, for which reason the enclosing sculpture should be made form transparent materials and be designed having its constituents panels having different figures than the enclosed one.

The sculptures shown in FIGS. 42*a, b* and 43*a, b* are intended for external location, but it is evident that they can be designed and made likewise for internal placement.

ELECTRIC SIGNBOARDS

The panels made in accordance with the present invention can be used to make electric signboards. In FIG. 37 there is shown an electric signboard representing in high relief, an assume tradename of a corporation. The letters of the tradename are formed in high relief by means of the high relief portions of the combined individual modules. This signboard is another example also of the use of the individual modules designated by the reference letter S in the annexed drawings, which do not have high relief portions, to complete those areas where such high relief are inexistent.

In this electric signboard it is also possible that the two geometries be both filled, through casting, melting or adherence, with equal or different materials, having the ratios and combinations previously mentioned. Likewise, it is possible to install an internal or external illuminations system.

LOGOTYPES

FIGS. 38 and 39 illustrate, respectively, the development of the design of a logotype and its final realization by means of the individual modules of the invention.

FIG. 38 shows that the design was made using a reticula as previously described and shown in FIG. 19 relating to the system for designing the panels of the invention, evidencing the practicability and facility of it to draft and perform the invention.

The logotypes thus obtained can be used in the same way that was previously discussed in respect of the murals and stained glass windows, placing them on walls, internal or external doors, etc., to identify a corporation or a department of it, etc.

FOLDING SCREENS

A use for the panels constituted in accordance with the invention similar to the internal and external partitions already described is to form folding screens, although they should be independent units, duly articulated, as by any joint or hinges, in order to be able to remain upward by themselves. In FIG. 45*a, b,* there is shown an example of this application. Of course, the folding screens can be made having the diverse alternatives applied and described in respect of the panels in general as well as the murals and stained glass windows.

DIVERSE ELEMENTS

Combining and fitting together the individual modules, and particularly the panels obtained through their combination, is evident that there are endless object or elements, decorative or artistic, that can be reformed. Thus, for instance, by forming the polyhedral bodies described in connection with FIG. 34 of the annexed drawings, it is possible to obtain telephone tables or supports, baskets, pots, mobiles, collages, etc.

In FIG. 40, for instance, there are shown several mirror frames made with individual modules of the invention, being able to have endless form and combinations, as well as styles and designs. It is possible to make panels defining an inner space, where for instance a mirror can be placed or a panel could be made constituting a whole body, as a backing board, to support the mirror.

The perimeter of the mirror frames so made may have also differnet forms, being, therefore, valid what was already said and discussed in respect to the perimeters illustrated in FIG. 17*a–n*.

CONCLUSION

From the foregoing description and the annexed drawings, it is evident that the individual modules and the system for fitting them together in order to form decorative or artistic panels, fulfill the objects previously mentioned, constituted a novel and original way to obtain them, having also fully demonstrated the practibility of the invention.

The individual modules 1, can be manufactured starting from any appropriate material, being a preferred but not limitative one, methyl methacrylate polymer, usually known through its registered trademark, PLEXIGLASS.

Every individual module may have different areas and volume, having the geometrical configurations already described, or similar ones, but as an example, the individual module 1 is 20 centimeters in width, 20 centimeters in depth and 43 centimeters in height including the raised borders 11, which in turn can have preferably, as well as raised borders 12, height of 2 millimeters.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

What is claimed is:

1. A system of individual modules which can be fitted together to form decorative artistic panels, comprising:

an individual module constituted by a geometrical body having a right parallelepiped configuration with quadrangular base, with upper and lower faces being larger than other face portions of said individual module, said lower face being open and said upper face having a plurality of high relief portions which are parallelepiped in configuration having rectangular bases and are quandrangular in cross section, parallel and spaced apart in location, producing jointly a hollow box with its lower base open and its upper base having said high relief portions which are hollow and in free communication with said box through their lower bases;

said high relief portions being disposed in parallel positions on said upper face of said box, as well as in spaced apart relationship; said positions being variable in accordance with the final design required;

said high relief portions dividing the upper face of the said module in several spaced apart sections, which are in a lower plane and adopt the configurations of said high relief portions which limit them;

said high relief portions producing two different planes or levels on the upper face of said individual module, with the spaced apart high relief portions having upper faces which constitute the upper plane or level, and the lower plane or level constituted by said sections limited by said high relief portions;

the upper faces of said high relief portions being confined in frame-like fashion by perimetrical raised borders having short height, defining an inner space in cell-like fashion, with its upper face open and having a polyhedral configuration that is similar to the high relief portion;

said lower plane sections being confined in frame-like fashion by perimetrical raised borders of the upper faces of said relief portions, excepting its sides abutting with the side faces of said high relief portions;

said high relief portions having different configurations with coincident geometrical axes; and said cell-like fashion inner spaces on the upper faces of said high relief portions and said cell-like fashion inner spaces on the lower plane defined by the lower perimetrical raised border and the side faces of said high relief portions defining inner spaces which can be filled by means of casting, melting or adherence, with materials having different origin, textures and colors.

2. The system of individual modules which can be fitted together to form decorative or artistic panels, as claimed in claim 1 in which said individual modules are fitted together in side-to-side relationship, adhered together by means or cement or adhesive, to form a decorative or artistic panel in which said high relief portions of every individual module is fitted together to the adjacent high relief portion of the adjacent individual module, conforming in combination a total geometrical figure in high relief, with the lower combined planes of the individual modules determining the pictorial background of the decorative or artistic panel thus formed.

3. The system of individual module which can be fitted together, as claimed in claim 1, wherein said individual modules can be joined to other similar modules by their respective rear edges, in order to structure volumetric bodies.

4. The system of individual modules which can be fitted together, as claimed in claim 1, wherein said individual modules are firmly joined by means of cement or adhesives to cover a wall.

5. The system of individual modules which can be fitted together, as claim in claim 3, wherein the individual modules are manufactured from transparent or translucid materials, or combinations thereof, to be used in the formation of stained glass windows.

6. The system of individual modules which can be fitted together, as claimed in claim 3, wherein the individual modules are used for the formation of individual decorative or utilitarian objects.

7. The system of individual modules which can be fitted together, as claimed in claim 3, wherein the individual modules are used for the formation of individual decorative or utilitarian objects.

8. An artistic module, which can be fitted together with a plurality of similar artistic modules to form artistic and decorative panels, said artistic module comprising:

an individual module constituted by a geometrical body having a right parallelepiped configuration with quadrangular base, with upper and lower faces being larger than other face portions of said individual module, said lower face being open and said upper face having a plurality of high relief portions which are parallelepiped in configuration having rectangular bases and are quadrangular in cross section, parallel and spaced apart in location, producing jointly a hollow box with its lower base open and its upper base having said high relief portions which are hollow and in free communication with said box through their lower bases;

said high relief portions being disposed in parallel positions on said upper face of said box, as well as in spaced apart relationship; said positions being variable in accordance with the final design required;

said high relief portions dividing the upper face of the said module in several spaced apart sections, which are in a lower plane and adopt the configurations of said high relief portions which limit them;

said high relief portions producing two different planes or levels on the upper face of said individual module, with the spaced apart high relief portions having upper faces which constitute the upper plane or level, and the lower plane or level constituted by said sections limited by said high relief portions;

the upper faces of said high relief portions being confined in frame-like fashion by perimetrical raised borders having short height, defining an inner space in cell-like fashion, with its upper face open and having a polyhedral configuration that is similar to the high relief portion;

said lower plane sections being confined in frame-like fashion by perimetrical raised borders of the upper faces of said relief portions, excepting its sides abutting with the side faces of said high relief portions;

said high relief portions having different configurations with coincident geometrical axes;

said cell-like fashion inner spaces on the upper faces of said high relief portions and said cell-like fashion inner spaces on the lower plane defined by the lower perimetrical raised border and the side faces of said high relief portions defining inner spaces which can be filled by means of casting, melting or adherence, with materials having different origin, textures and colors.

* * * * *